US005289173A

United States Patent [19]

Numao

[11] Patent Number: 5,289,173

[45] Date of Patent: Feb. 22, 1994

[54] DISPLAY CONTROL METHOD HAVING PARTIAL REWRITING OPERATION

[75] Inventor: Takaji Numao, Nara, Japan

[73] Assignee: Sharp Kabushiki Kaisha, Osaka, Japan

[21] Appl. No.: 767,158

[22] Filed: Sep. 27, 1991

[30] Foreign Application Priority Data

Sep. 27, 1990 [JP] Japan ..... 2-259986
Sep. 27, 1990 [JP] Japan ..... 2-259987

[51] Int. Cl.[5] ..... G09G 3/36

[52] U.S. Cl. ..... 345/87; 345/97

[58] Field of Search ..... 340/784, 750, 747, 798, 340/799, 748, 805; 358/135, 136; 359/56, 55

[56] References Cited

U.S. PATENT DOCUMENTS 4,693,563 9/1987 Harada et al. ..... 340/784
4,717,957 1/1988 Santamäki et al. ..... 358/136

FOREIGN PATENT DOCUMENTS

0256879A2 2/1988 European Pat. Off. .
0281160A1 9/1988 European Pat. Off. .
0293235 11/1988 European Pat. Off. .
0306822A2 3/1989 European Pat. Off. .
0318050 5/1989 European Pat. Off. .
0361471 4/1990 European Pat. Off. .
0368117 5/1990 European Pat. Off. .
0435701A2 7/1991 European Pat. Off. .
0059389 3/1989 Japan .
0254923 11/1989 Japan .
0093583 4/1990 Japan .

*Primary Examiner*—Alvin E. Oberley
*Assistant Examiner*—Chanh Nguyen
*Attorney, Agent, or Firm*—David G. Conlin; George W. Neuner

[57] ABSTRACT

An interlaced scanning, in which every adjoining plural scanning electrodes are rewritten at the rate of one scanning electrode and all of the picture elements are rewritten in plural fields, is conducted at a constant period. Furthermore, during the transcribing operation of the picture elements, a partial rewriting operation is performed wherein a selective voltage is applied to the scanning electrode where data to be displayed on the picture elements of liquid crystal display device has changed, and a signal voltage is applied to the signal electrode responsive to, whether the picture elements on the selected scanning electrode should be changed from a bright display state to a dark display state, or from the dark display state to the bright display state, or the bright and dark display states are not changed. By bringing the field frequency of the transcribing operation above 30 Hz, even when the sixteen adjoining scanning electrodes are rewritten at the rate of one scanning electrode, the display with little flickers can be accomplished.

7 Claims, 33 Drawing Sheets

Fig. 5 (1) PRIOR ART
Fig. 5 (2) PRIOR ART
Fig. 5 (3) PRIOR ART
Fig. 5 (4) PRIOR ART
Fig. 5 (5) PRIOR ART
Fig. 5 (6) PRIOR ART (1) SELECTIVE A (2) NON-SELECTIVE B (3) BRIGHT REWRITING C (4) DARK REWRITING D (5) NON-REWRITING G (6) A - C (7) A - D (8) A - G (9) B - C

(10) B - D

(11) B - G
V
Vp
0
-Vp
2Vp
-2Vp
t
0
6to (1) SELECTIVE A (2) NON-SELECTIVE B (5) NON-REWRITING G (4) DARK REWRITING D (3) BRIGHT REWRITING C (8) A - G (7) A - D (6) A - C

(11) B - G

(10) B - D (9) B - C
V
VD
0
-VD
2VD
-2VD
t
0
6to

Fig.9 Prior Art(1) YCK-
Fig.9 Prior Art(2) YI
Fig.9 Prior Art(3) DATA
Fig.9 Prior Art(4) LCK-
Fig.9 Prior Art(5) YCK-
Fig.9 Prior Art(6) YI
Fig.9 Prior Art(7) DATA
Fig.9 Prior Art(8) XCK
Fig.9 Prior Art(9) LP
Fig.9 Prior Art(10) VC
Fig.9 Prior Art(11) VS Fig.10 Prior Art(1) YCK-
Fig.10 Prior Art(2) Y1
Fig.10 Prior Art(3) DATA
32 4 8 12 16 20 24 28 32 4 8 12 16 20 24 28 32 4 8 12
Fig.10 Prior Art(4) LCK- (1) SELECTIVE A (2) NON-SELECTIVE B (3) BRIGHT REWRITING C (4) DARK REWRITING D (5) NON-REWRITING G (6) A-C (7) A-D (8) A-G (9) B-C

(10) B-D

(11) B-G
V
3Vp
2Vp
Vp
0
-Vp
-2Vp
-3Vp
0
6to
t

Fig.14 (1) YCLK
PRIOR ART
Fig.14 (2) YI
PRIOR ART
Fig.14 (3) VOLTAGE OF L1
PRIOR ART
V
B B A B B
Fig.14 (4) VOLTAGE OF L2
PRIOR ART
V
B B B A B
Fig.14 (5) VOLTAGE OF L3
PRIOR ART
V
B B B B A
Fig.14 (6) VOLTAGE OF S5
PRIOR ART
V
G(E) G(F) D C G(E)
Fig.14 (7) VOLTAGE OF S6
PRIOR ART
V
G(F) G(F) G(E) G(F) G(F)
Fig.14 (8) VOLTAGE OF A1.5
PRIOR ART
V
BG BG AD BC BG
Fig.14 (9) VOLTAGE OF A1.6
PRIOR ART
V
BG BG AG BG BG
Fig.14 (10) VOLTAGE OF A2.5
PRIOR ART
V
BG BG BD AC BG
Fig.14 (11) VOLTAGE OF A2.6
PRIOR ART
V
BG BG BG AG BG
t

Fig. 19 (1) ADDR
Fig. 19 (2) DATA
Fig. 19 (3) LP
Fig. 19 (4) DATA
Fig. 19 (5) LP
Fig. 19 (6) XCK
Fig. 19 (7) VC
Fig. 19 (8) VS

Fig. 20 (1) ADDR
16 2 20 6 24 10 28 14 32 18 4 22 8 26 12 30 16 1 20 5 24 9 28 13 32 17 4 21 8 25 12 29 16
Fig. 20 (2) DATA
16 2 20 6 24 10 28 14 32 18 4 22 8 26 12 30 16 1 20 5 24 9 28 13 32 17 4 21 8 25 12 29 16 4
Fig. 20 (3) LP

Fig. 28 (1) YCLK
Fig. 28 (2) YI
Fig. 28 (3) DATA
Fig. 28 (4) LCLK
Fig. 28 (5) YCLK
Fig. 28 (6) YI
Fig. 28 (7) DATA
Fig. 28 (8) XCLK
Fig. 28 (9) LP
Fig. 28 (10) VC
Fig. 28 (11) VS

Fig. 29 (1) YCLK
Fig. 29 (2) YI
Fig. 29 (3) DATA
Fig. 29 (4) LCLK
32
3
7
11
15
19
23
27
31
2
6
10
14
18
22
26
30
1
5
9

Fig.31 (1)
IMPRESSED VOLTAGE
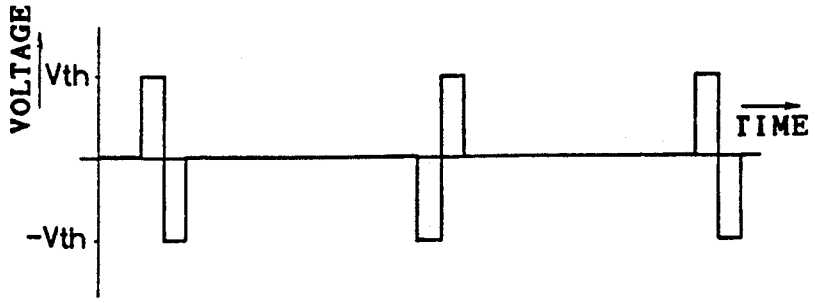
Fig.31 (2)
TRANSMISSION LIGHT QUANTITY
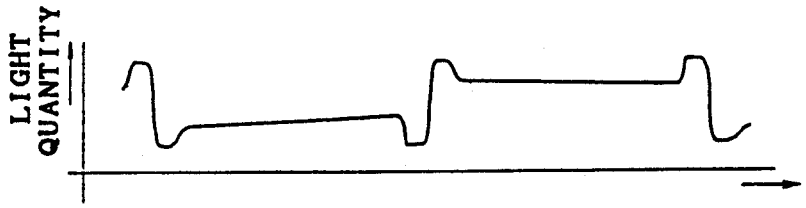
Fig.31 (3)
IMPRESSED VOLTAGE
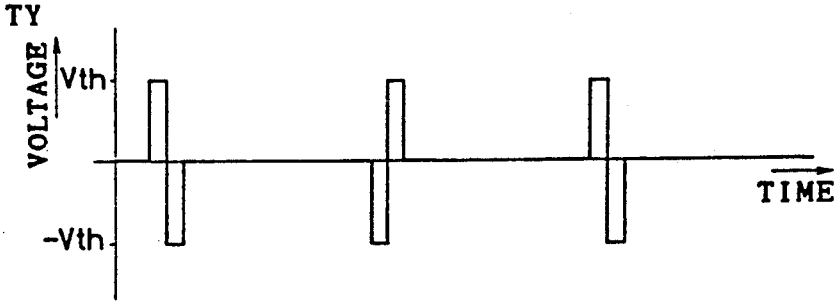
Fig.31(4)
TRANSMISSION LIGHT QUANTITY
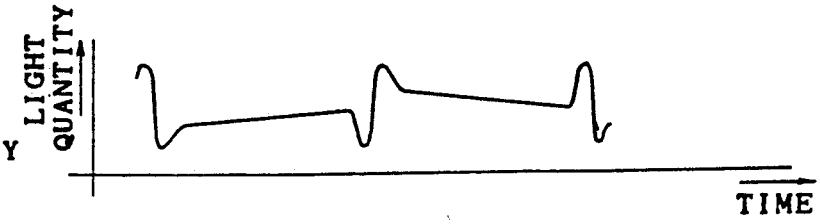

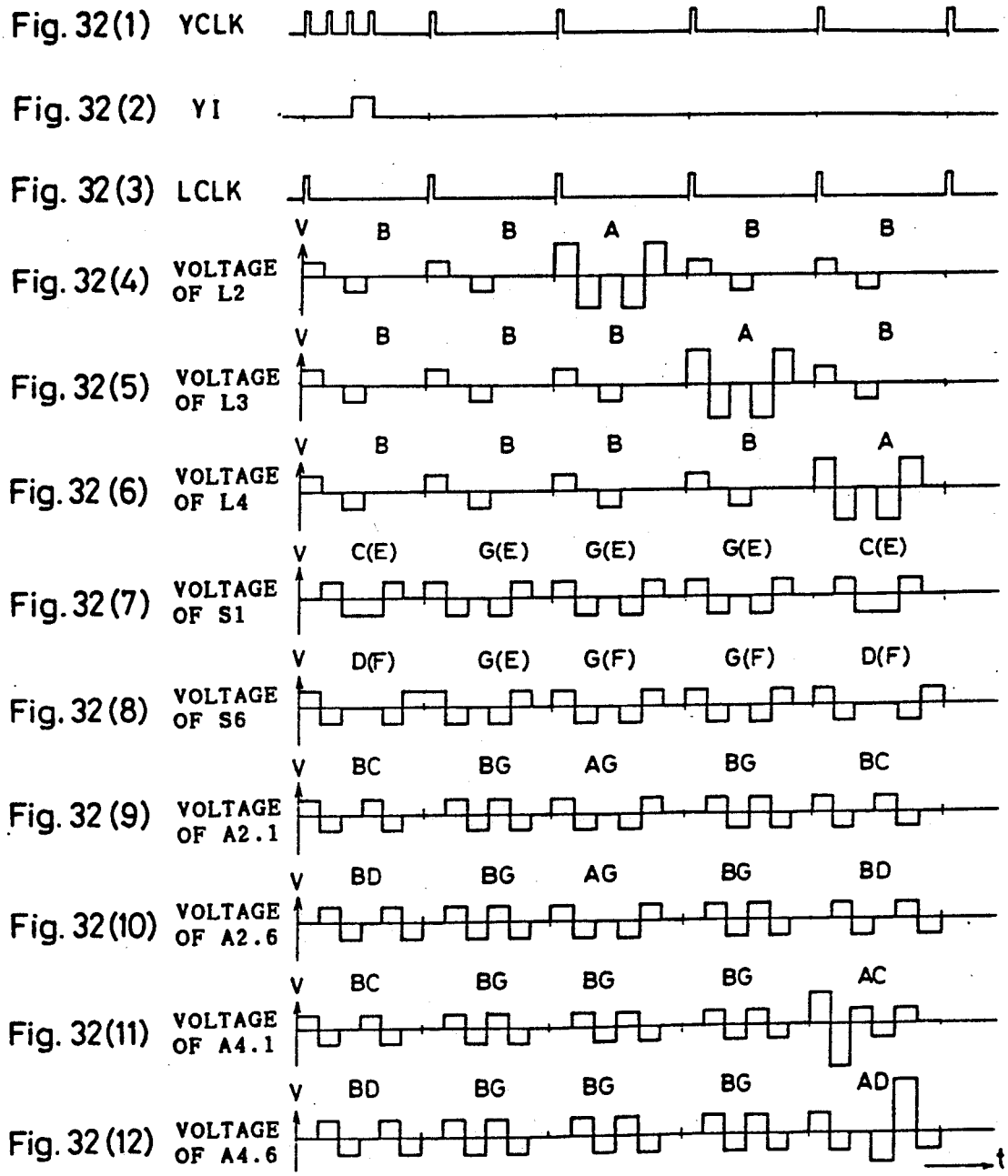
Fig. 32(1) YCLK
Fig. 32(2) YI
Fig. 32(3) LCLK
Fig. 32(4) VOLTAGE OF L2
V B B A B B
Fig. 32(5) VOLTAGE OF L3
V B B B A B
Fig. 32(6) VOLTAGE OF L4
V B B B B A
Fig. 32(7) VOLTAGE OF S1
V C(E) G(E) G(E) G(E) C(E)
Fig. 32(8) VOLTAGE OF S6
V D(F) G(E) G(F) G(F) D(F)
Fig. 32(9) VOLTAGE OF A2.1
V BC BG AG BG BC
Fig. 32(10) VOLTAGE OF A2.6
V BD BG AG BG BD
Fig. 32(11) VOLTAGE OF A4.1
V BC BG BG BG AC
Fig. 32(12) VOLTAGE OF A4.6
V BD BG BG BG AD
t

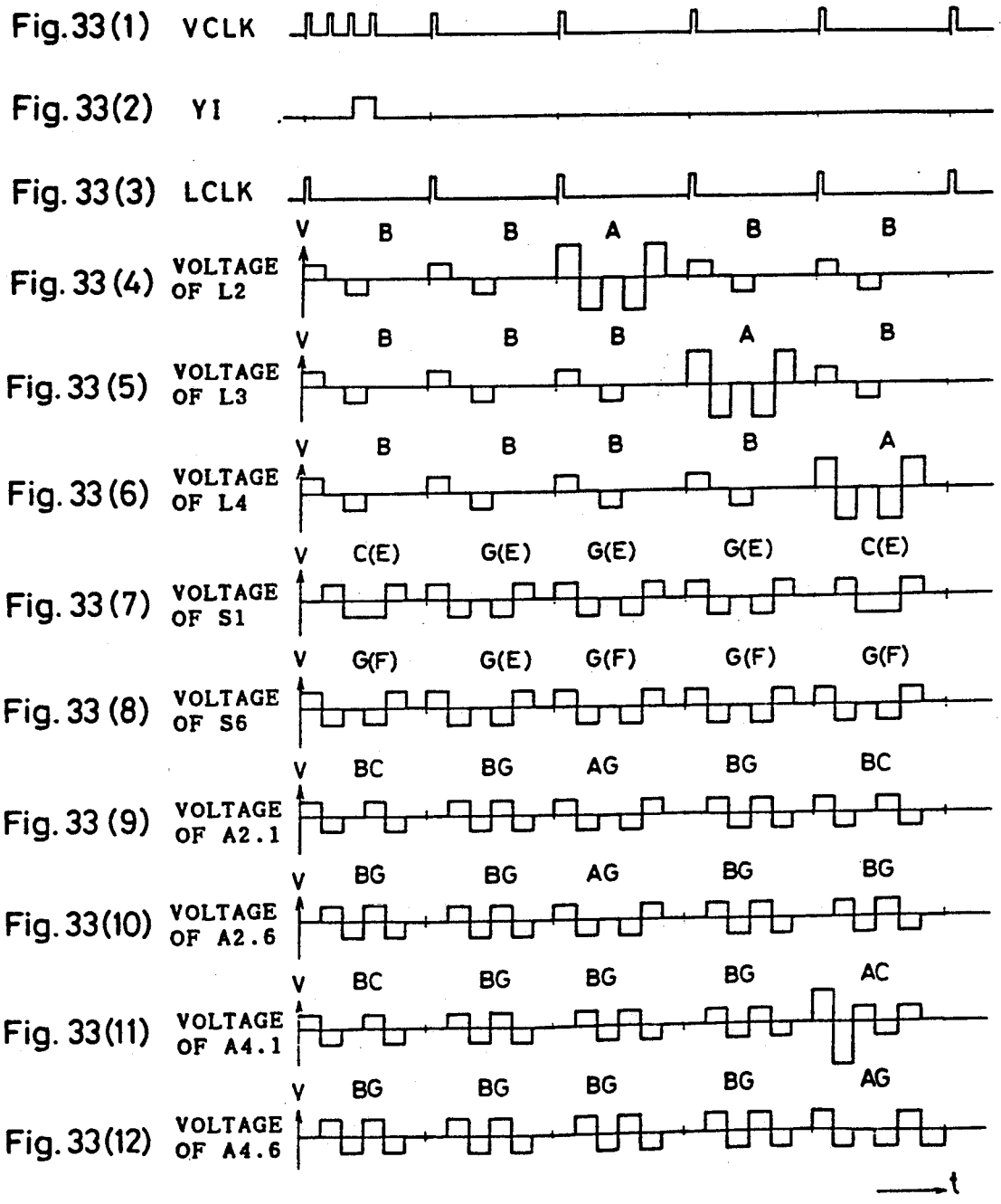
Fig.33(1) VCLK
Fig.33(2) YI
Fig.33(3) LCLK
Fig.33(4) VOLTAGE OF L2
V B B A B B
Fig.33(5) VOLTAGE OF L3
V B B B A B
Fig.33(6) VOLTAGE OF L4
V B B B B A
Fig.33(7) VOLTAGE OF S1
V C(E) G(E) G(E) G(E) C(E)
Fig.33(8) VOLTAGE OF S6
V G(F) G(E) G(F) G(F) G(F)
Fig.33(9) VOLTAGE OF A2.1
V BC BG AG BG BC
Fig.33(10) VOLTAGE OF A2.6
V BG BG AG BG BG
Fig.33(11) VOLTAGE OF A4.1
V BC BG BG BG AC
Fig.33(12) VOLTAGE OF A4.6
V BG BG BG BG AG
t

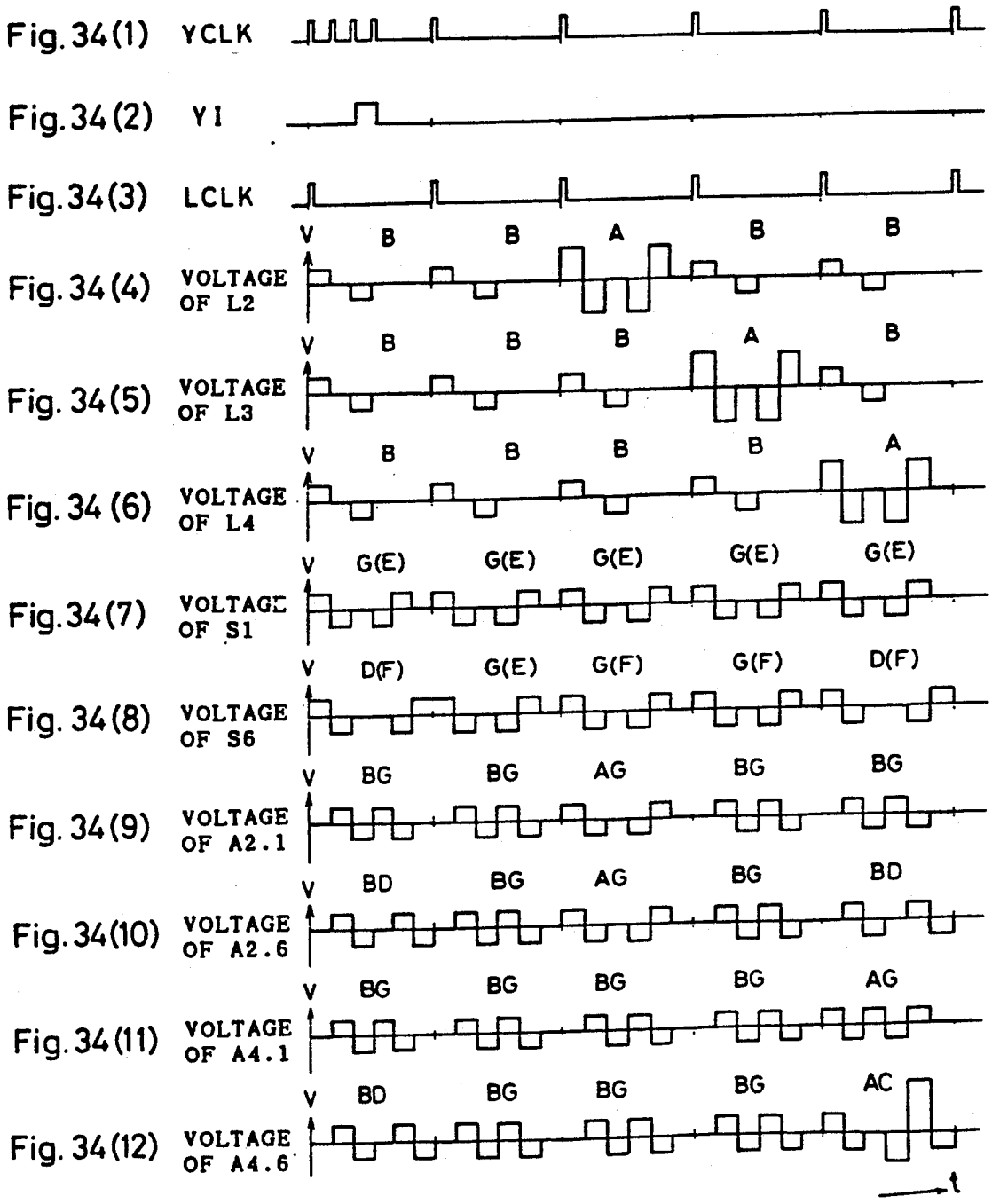
Fig. 34(1) YCLK
Fig. 34(2) Y1
Fig. 34(3) LCLK
Fig. 34(4) VOLTAGE OF L2
V B B A B B
Fig. 34(5) VOLTAGE OF L3
V B B B A B
Fig. 34(6) VOLTAGE OF L4
V B B B B A
Fig. 34(7) VOLTAGE OF S1
V G(E) G(E) G(E) G(E) G(E)
Fig. 34(8) VOLTAGE OF S6
V D(F) G(E) G(F) G(F) D(F)
Fig. 34(9) VOLTAGE OF A2.1
V BG BG AG BG BG
Fig. 34(10) VOLTAGE OF A2.6
V BD BG AG BG BD
Fig. 34(11) VOLTAGE OF A4.1
V BG BG BG BG AG
Fig. 34(12) VOLTAGE OF A4.6
V BD BG BG BG AC
t

DISPLAY CONTROL METHOD HAVING PARTIAL REWRITING OPERATION

BACKGROUND OF THE INVENTION

1. Field of the Invention

The present invention relates to a display control method and apparatus for liquid crystal display device in which a ferroelectric liquid crystal (hereinafter abbreviated as FLC) is used.

2. Description of the Prior Art

FIG. 1 is a sectional view showing a schematic configuration of an FLC panel. Two sheets of glass substrates 5a, 5b are disposed in opposition to each other. A signal electrode S consisting of indium tin oxide (hereinafter abbreviated as ITO) is arranged plurally in parallel on the surface of one glass substrate 5a, and further, its surface is covered by a transparent insulating film 6a consisting of $SiO_2$. On the surface of the other glass substrate 5b apposing to the signal electrode S, a scanning electrode L consisting of ITO is arranged plurally in parallel in a direction orthogonal to the signal electrode S, and covered by a transparent insulating film 6b consisting of $SiO_2$. On the insulating films 6a, 6b, orientation films 7a, 7b consisting of polyvinyl alcohol and treated by rubbing processing are formed respectively.

The two glass substrates 5a, 5b are bonded together with a sealing agent 8 partially leaving an injection port, which is sealed by the sealing agent 8 after the FLC 9 is introduced into a space between the orientation films 7a, 7b by the vacuum injection therethrough. The two glass substrates 5a, 5b thus bonded together are clamped between two polarizing plate 10a, 10b which are arranged such that respective polarizing axes intersect orthogonally.

FIG. 2 is a block diagram schematically showing a configuration of display device using the aforesaid FLCD 1. In the display device information necessary for the image display is obtained from a digital signal outputted to a CRT display 3 from a personal computer 2. The digital signal is transformed into a drive signal for displaying images on the FLCD 1 in a control circuit 4, (illustrated in FIG. 6) and the image display on the FLCD 1 is effected by the drive signal.

FIG. 3 and FIG. 4 are plan views showing the configuration of an FLC display (hereinafter abbreviated as FLCD) 1, in which a scanning side driving circuit 11 is connected to the scanning electrode L of the FLCD 1 having a simple matrix configuration aforementioned, and a signal side driving circuit 12 is connected to the signal electrode S. The scanning side driving circuit 11 is a circuit for applying voltages to the scanning electrodes L, and the signal side driving circuit 12 is a circuit for applying voltages to the signal electrodes S.

Here, for the purpose of simplification, the case wherein a number of the scanning electrodes L are 32 and a number of the signal electrodes S are 16, or the case of FLCD 1 constituting by picture elements of $32\times16$ is shown, and respective electrodes of the scanning electrodes L are distinguished by adding an index i ($i=1$ to 32), to the symbol L, and respective electrodes of the signal electrodes S are distinguished by adding an index j ($j=1$ to 16) to the symbol S. In the description made hereinafter, a picture element at intersection of any scanning electrode Li and any signal electrode Sj is represented by a symbol Aij.

FIG. 5 is a waveform diagram of signals outputted from the personal computer 2 to the CRT display 3 above-mentioned. FIG. 5 (1) is a horizontal synchronizing signal HD- which gives the period of one horizontal scanning interval of image information outputted to the CRT display 3, FIG. 5 (2) is a vertical synchronizing signal VD- which gives the period of one picture screen of the information, and FIG. 5 (3) shows the information as display data Data for every horizontal scanning interval in the lump, index numerals corresponding to the scanning electrode Li of the FLCD 1.

FIG. 5 (4) is a waveform diagram showing an expanded one horizontal scanning interval of the horizontal synchronizing signal HD-, FIG. 5 (5) is a waveform diagram showing an expanded one horizontal scanning interval of the display data Data, index numerals corresponding to the signal electrode Sj of the FLCD 1, and FIG. 5 (6) is a waveform diagram showing a data transfer clock CLK of the display data Data for every picture element.

FIG. 6 is a block diagram schematically showing a configuration of the control circuit 4. A display memory 16 is for storing display data Data of one picture screen outputted from the personal computer 2 of FIG. 2. From the display memory 16, transformation data Rx showing the difference between the display data displayed, at present, on the picture screen of the FLCD 1 and the display data to be displayed in the next frame is outputted to a discriminating memory 17 and a reference memory 18, and display data Do to be displayed in the next frame is outputted to a drive control circuit 19.

The discriminating memory 17 stores, in response to the transformation data Rx outputted from the display memory 16, whether or not there is even one picture element on the scanning electrode of the FLCD 1 where the display data displayed at present differs from the display data to be displayed in the next frame, as discrimination data for every scanning electrode. In the discriminating memory 17, one-bit memory capacity is allocated respectively to hold the discrimination data for every scanning electrode, and outputted to the output control circuit 14 as discrimination data SAME-. The reference memory 18 stores the transformation data Rx of one picture screen outputted from the display memory 16 as it is.

An input control circuit 13 is the circuit which, in response to the horizontal synchronizing signal HD-, vertical synchronizing signal VD- and clock CLK outputted from the personal computer 2, controls the input side operation of the display memory 16, discriminating memory 17 and reference memory 18 directly or indirectly through an input/output switching circuit 15.

The output control circuit 14 is the circuit which, in response to the discrimination data SAME- outputted from the discriminating memory 17 and an internal clock CK, controls the output side operation of the display memory 16, discriminating memory 17 and reference memory 18 directly or indirectly through the input/output switching circuit 15, and at the same time, indicates the display position of display data DATA outputted from the drive control circuit 19 on the FLCD 1.

The input/output switching circuit 15 is the circuit which, in response to the signals of the input control circuit 13 and the output control circuit 14, switches the input/output timing of the display memory 16, discriminating memory 17 and the reference memory 18.

The drive control circuit 19 is the circuit which outputs image data DATA on the basis of the display data Do given from the display memory 16 and difference data Dre given from the reference memory 18, and in response to the signal given from the output control circuit 14, outputs the signal giving a display position of the image data DATA on the FLCD 1, a selective voltage VCa, a non-selective voltage VCb, a non-rewriting voltage VSg, a dark rewriting voltage VSd and a bright rewriting voltage VSe to the FLCD 1.

FIG. 7 and FIG. 8 are specific voltage waveforms of the selective voltage VCa and non-selective voltage VCb applied to the scanning electrode L, and the non-rewriting voltage VSg, dark rewriting voltage VSd and bright rewriting voltage VSc applied to the signal electrode S. Waveforms shown in FIG. 7 (1) and FIG. 8 (1) are of the selective voltage VCa which is applied to the scanning electrode L for rewriting the memory state of the picture elements on the scanning electrode L, or the luminous state displayed, and waveforms shown in FIG. 7 (2) and FIG. 8 (2) are the non-selective voltage VCb which is applied to the other scanning electrodes L for not rewriting the display state of the picture elements thereon. Waveforms shown in FIG. 7 (5) and FIG. 8 (5) are of the non-rewriting voltage VSg which is applied to the signal electrode S for not rewriting the display state of the picture elements on the scanning electrode L to which the selective voltage VCa is applied, waveforms shown in FIG. 7 (4) and FIG. 8 (4) are of the dark rewriting voltage VSd which is applied to the signal electrode S for rewriting the display state of the picture elements on the scanning electrode L to which the selective voltage VCa is applied into a "dark" luminous state and waveforms shown in FIG. 7 (3) and FIG. 8 (3) are of the bright rewriting voltage VSc which is applied to the signal electrode S for rewriting the display state of the picture elements on the scanning electrode L to which selective voltage VCa is applied, into a "bright" luminous state.

FIG. 7 (6) to FIG. 7(11) and FIG. 8 (6) to FIG. 8 (11) respectively show waveforms of the effective voltage applied to the picture element Aij. A waveform A-G of FIG. 7 (8) and FIG. 8 (8) shows the voltage waveform applied to the picture element Aij, when the selective voltage VCa is applied to the scanning electrode Li and the non-rewriting voltage VSg is applied to the signal electrode Sj, a waveform A-D of FIG. 7 (7) and FIG. 8 (7) shows the voltage waveform applied to the picture element Aij, when the selective voltage VCa is applied to the scanning electrode Li and the dark rewriting electrode VSd is applied to the signal electrode Sj, a waveform A-C of FIG. 7 (6) and FIG. 8 (6) shows the voltage waveform applied to the picture element Aij, when the selective voltage VCa is applied to the scanning electrode Li and the bright rewriting voltage VSc is applied to the signal electrode Sj, a waveform B-G of FIG. 7 (11) and FIG. 8 (11) shows the voltage waveform applied to the picture element Aij, when the non-selective voltage VCb is applied to the scanning electrode Li and the non-rewriting voltage VSg is applied to the signal electrode Sj, a waveform B-D of FIG. 7 (10) and FIG. 8 (10) shows the voltage waveform applied to the picture element Aij, when the non-selective voltage VCb is applied to the scanning electrode Li and the dark rewriting voltage VSd is applied to the signal electrode Sj, and a waveform B-C of FIG. 7 (9) and FIG. 8 (9) shows the voltage waveform applied to the picture element Aij, when the non-selective voltage VCb is applied to the scanning electrode Li and the bright rewriting voltage VSc is applied to the signal electrode Sj.

FIG. 9 and FIG. 10 are waveform diagrams showing drive signal outputted to the FLCD 1 from the control circuit 4, in case the display state of the picture elements Aij of the FLCD 1 is rewritten from Japanese characters meaning "FERROELECTRIC" shown in FIG. 4 to Japanese Characters meaning "ORDINARY DIELECTRIC" shown in FIG. 3 by using the control circuit 4 of FIG. 6 aforementioned. FIG. 9 (2) and FIG. 10 (2) are waveform diagrams showing a selective signal YI for selecting the scanning electrode Li, FIG. 9 (1) and FIG. 10 (1) are waveform diagrams showing the clock YCK- for sequentially transferring the selective signal YI in a shift register, not shown, included in the scanning side during circuit 11, FIG. 9 (4) and FIG. 10 (4) are waveform diagrams showing the clock LCK- which takes in and holds the selective signal YI in a shift register, not shown, included in the same scanning side driving circuit 11, and FIG. 9 (3) and FIG. 10 (3) show display data DATA corresponding to the picture elements of the FLCD 1, index numerals corresponding to the scanning electrodes Li of the FLCD 1.

FIG. 9 (5) is a waveform diagram showing the expanded clock YCK- for one selective time, FIG. 9 (6) is a waveform diagram showing the expanded selective signal YI for one selective time, and FIG. 9 (7) is a waveform diagram showing the expanded display data DATA for one selective time, index numerals corresponding to the signal electrodes Sj of the FLCD 1.

FIG. 9 (8) is a waveform diagram showing a data transfer clock XCK for sequentially transferring the display data DATA in a shift register, not shown, included in the signal side driving circuit 12, FIG. 9 (9) is a waveform diagram showing a latch pulse LP which gives timing for taking in and holding simultaneously the display data DATA in a shift register, not shown, included in the signal side driving circuit 12, in a separate shift register, not shown, included in the signal side driving circuit 12, FIG. 9 (10) is a waveform diagram schematically showing voltages VCa, VCb applied to the scanning electrode L, and FIG. 9 (11) is a waveform diagram schematically showing voltages VSc, VSd, VSg applied to the signal electrode S. FIG. 10 (1) to FIG. 10 (4) show waveforms following the waveforms of FIG. 9 (1) to FIG. 9 (4).

The conventional driving method will be described along the waveform diagrams shown in FIG. 9 and FIG. 10. In a frame in which Japanese characters meaning "FERROELECTRIC" are shown on the picture screen of the FLCD 1, display data Do stored in the display memory 16 are the state of picture elements of 32×16 in FIG. 4 itself, and discrimination data stored in the discriminating memory 17 are all brought to "0".

Since the display data Data displaying Japanese characters meaning "ORDINARY DIELECTRIC" is sent to the display memory 16 from the personal computer 2 in this state, from the display memory 16, transformation data Rx of one picture screen which is the difference between "FERROELECTRIC" and "ORDINARY DIELECTRIC" and shown schematically in FIG. 11, is sent to the discriminating memory 17 and the reference memory 18. Though the transformation data Rx is held as it is in the reference memory 18, the transformation data Rx for one scanning electrode are held in the lump in the discriminating memory 17. That is, "1" is held from the scanning electrodes L1 to L16, and "0" is held from the scanning electrodes L17 to L32.

Waveforms in FIG. 9 and FIG. 10 explain the operation thereafter. The output control circuit 14 outputs an output side line address OAc "1" to the display memory 16, discriminating memory 17 and reference memory 18 through the input/output switching circuit 15, and checks discrimination data SAME- which is the output signal of the discriminating memory 17. As described above, since the value of discrimination data corresponding to the scanning electrode L1 is "1", output side row addresses OAs "1" to "4" are outputted to the display memory 16 and the reference memory 17, display data Do and difference data Dre corresponding to the scanning electrode L1 are outputted to the drive control circuit 19, and the value of discrimination data corresponding to the scanning electrode L1 of the discriminating memory 17 is returned to "0".

The drive control signal 19 outputs the "dark rewriting" signal to the signal side driving circuit 12 of the FLCD 1 as display data DATA, when the display data Do is "dark" and the difference data Dre is "change", outputs the "bright rewriting" signal as display data DATA when the display data Do is "bright" and the difference data Dre is "change", and outputs the "non-rewriting" signal as display data DATA when the display data Do is "bright" or "dark" and the difference data Dre is "same".

Though the output control circuit 14 then outputs the output side line address OAc "2", the control circuit 4 repeats the aforesaid operations till the output side address OAc becomes "17".

When the output control circuit 14 outputs the output side line address OAc "17" and check discrimination data SAME- which is the output signal of the discriminating memory 17, since the value of discrimination data corresponding to the scanning electrode L17 is "0", the output control circuit 14 rechecks discrimination data SAME-designating the output side line address OAc as "18". Though the operations are repeated up to four times, whenever the output control circuit 14 outputs the output side line address OAc "20", regardless of the value of discrimination data SAME- which is the output signal of the discriminating memory 17, the output side row address OAs is outputted to the display memory 16 and the reference memory 17, the display data Do and difference data Dre are outputted to the drive control circuit 19, and the value of discrimination data of the discriminating memory 17 corresponding to the scanning electrode L1 is returned to "0".

The drive control circuit 19 outputs the display data DATA to the signal side driving circuit 12 of the FLCD 1 in the basis of the display data Do and difference data Dre as described above.

Though the operation is repeated hereinafter, when image information outputted from the personal computer 2 has changed while repeating the operation, in accordance with the change the stored contents of the display memory 16, discriminating memory 17 and reference memory 18 will change similarly to the case wherein the image information has changed from "FERROELECTRIC" to "ORDINARY DIELECTRIC" aforementioned. In the discriminating memory 17, the discrimination data which was "1" at that time does not change but remains as "1".

Though display data DATA is inputted to the signal side driving circuit 12 in such a matter, in the signal side driving circuit 12, the display data DATA is sequentially transferred in the shift register, not shown, by the data transfer clock XCK, and taken into the separate register, not shown, in synchronism with the latch pulse LP. When the value of display data DATA taken into the register is "dark rewriting" the dark rewriting voltage VSd is applied to the corresponding signal electrode, when the value of display data DATA is "bright rewriting" the bright rewriting voltage VSc is applied to the corresponding signal electrode, and when the value of display data DATA is "non-rewriting" the non-rewriting voltage VSg is applied to the corresponding signal electrode.

For indicating the scanning electrode corresponding to the display data DATA taken into the register aforementioned, the selective signal YI and clock signals YCK-, LCK- are outputted from the drive control circuit 19.

In the scanning side driving circuit 11, the selective signal YI is sequentially transferred in the shift register, not shown, included in the scanning side driving circuit 11 by the transfer clock YCK-, and taken into the separate register, not shown, included in the scanning side driving circuit 11 in synchronism with the hold clock LCK-. When the value of the selective signal YI taken into the register is "1" the selective voltage VCa is applied to the corresponding scanning electrode, and when the value of the selective signal YI is "0" the selective voltage VCb is applied to the corresponding scanning electrode.

According to such conventional driving method, for the picture elements on the scanning electrode whose display data displayed at present and the display data in the next frame is same, since only the non-rewriting voltage is applied to the signal electrode even when the scanning electrode is not selected or selected, it is possible to display without flickers by rewriting the picture elements even when the number of scanning electrodes of the FLCD is increased.

Such a conventional driving method has been proposed in Japanese Patent application Laid Open No. sho 64-59389 (1989), and as the impressed voltage waveforms to the scanning electrode L and the signal electrode S used usually in the driving method of the FLCD 1, explained by the waveform diagram shown in FIG. 12 in place of FIG. 7 and FIG. 8. A waveform shown in FIG. 12 (1) is the waveform of a selective voltage A which is applied to the scanning electrode L, and is able to rewrite the memory state of the picture elements on the scanning electrode L or the luminous state displayed, and a waveform shown in FIG. 12 (2) is the waveform of an non-selective voltage B which is applied to the scanning electrode L, but can not rewrite the display state of the picture elements on the scanning electrode L.

A waveform shown in FIG. 12(3) is the waveform of a bright rewriting voltage C which is applied to the signal electrode S when rewriting the picture elements into the "bright" luminous state, a waveform shown in FIG. 12(4) is the waveform of a dark rewriting voltage D which is applied to the signal electrode S when rewriting the picture elements into the "dark" luminous state, and a waveform shown in FIG. 12(5) is the waveform of a non-rewriting voltage G which is applied to the signal electrode S when the display state of the picture elements is not rewritten.

FIG. 12(6) to FIG. 12(11) are waveform diagrams showing waveforms of an effective voltage applied to the picture element Aij. A waveform A-C of FIG. 12(6) shows the waveform when the selective voltage A is applied to the scanning electrode Li and the bright rewriting voltage C is applied to the signal electrode Sj, a waveform A-D of FIG. 12(7) shown the waveform when the selective voltage A is applied to the scanning electrode Li and the dark rewriting voltage D is applied to the signal electrode Sj, a waveform A-G of FIG. 12(8) shows the waveform when the selective voltage A is applied to the scanning electrode Li and the non-rewriting voltage G is applied to the signal electrode Sj, a waveform B-C of FIG. 12(9) shows the waveform when the non-selective voltage B is applied to the scanning electrode Li and the bright rewriting voltage C is applied to the signal electrode Sj, a waveform B-D of FIG. 12(10) shows the waveform when the non-selective voltage B is applied to the scanning electrode Li and the dark rewriting voltage D is applied to the signal electrode Sj, and a waveform B-G of FIG. 12(11) shows the waveform when the non-selective voltage B is applied to the scanning electrode Li and the non-rewriting voltage G is applied to the signal electrode Sj.

In case the display state of the picture elements Aij of the FLCD 1 of FIG. 4 is rewritten by the aforesaid driving method, the selective voltage A shown in FIG. 12(1) is applied to the scanning electrode Li, and the non-selective voltage B shown in FIG. 12(2) is applied to all remaining scanning electrodes Lk($k \neq i$, $k=1$ to 32), when the picture elements Aij are rewritten into the "bright" display state, the bright rewriting voltage C shown in FIG. 12(3) is applied to the signal electrode Sj, when the picture elements Aij are rewritten into the "dark" display state, the dark rewriting voltage D shown in FIG. 12(4) is applied to the signal electrode Sj, and when the "bright" display state or the "dark" display state of the picture elements Aij in the preceding frame may be kept as it is, the non-rewriting voltage G shown in FIG. 12(5) is applied to the signal electrode Sj.

For instance, in case the state wherein Japanese characters meaning "FERROELECTRIC" are displayed on the picture screen by the picture elements Aij which are in the "dark" display state shown by oblique lines in the FLCD 1 of FIG. 4, is rewritten into the state wherein Japanese characters meaning "ORDINARY DIELECTRIC" are displayed as shown in FIG. 3, the picture elements Aij which are rewritten from the "dark" display state to the "bright" display state are represented in FIG. 13 by a symbol C corresponding to the bright rewriting voltage C, the picture elements Aij which are rewritten from the "bright" display state to the "dark" display state are represented by a symbol D corresponding to the dark rewriting voltage D, the picture elements Aij which are kept in the "dark" display state as it is are represented by a symbol F and the picture elements Aij which are kept in the "bright" display state as it is are represented by no symbol. Therefore, whole image is indicated in FIG. 3. In this case, the picture elements Aij with symbol F and the picture elements Aij without symbol correspond to the non-rewriting voltage G.

FIG. 14 shows respective voltage waveforms applied then to the scanning electrodes L1, L2, L3, signal electrodes S5, S6 and picture elements A15, A16, A25, A26. FIG. 14(1) shows, as a reference, the waveform of a transfer clock YCLK of the selective signal YI in a shift register in the scanning side driving circuit 11, FIG. 14(2) shows the waveform of the selective signal YI, FIG. 14(3) shows the impressed voltage waveform to the scanning electrode L1, FIG. 14(4) shows the impressed voltage waveform to the scanning electrode L2, FIG. 14(5) shows the impressed voltage waveform to the scanning electrode L3, FIG. 14(6) shows the impressed voltage waveform the signal electrode S5, FIG. 14(7) shows the impressed voltage waveform to the signal electrode S6, FIG. 14(8) shows the effective voltage waveform applied to the picture element A15, FIG. 14(9) shows the effective voltage waveform applied to the picture element A16, FIG. 14(10) shows the effective voltage waveform applied to the picture element A25 and FIG. 14(11) shows the effective voltage waveform applied to the picture element A26.

In the driving method stated above, as it will be understood from the effective voltage of the picture element A16 shown in FIG. 14(9), and the effective voltage of the picture element A26 shown in FIG. 14(11), the voltages applied to the picture elements Aij are substantially equal as long as its display state is not rewritten, regardless of selecting or not selecting the scanning electrode Li. From this fact, even in the case of low-speed driving, wherein the time required from applying the selective voltage A to a certain scanning electrode Li till applying the selective voltage A next to the same scanning electrode Li, or one frame period is longer than 33.3 milliseconds (corresponds to 30 Hz), the display without flickers is possible.

In the FLCD in which the driving method described above can be adopted, as far as the non-selective voltage is applied to the scanning electrode Li, or the selective voltage is applied to the scanning electrode Li but the non-rewriting voltage is applied to the signal electrode Sj, the display state of the picture element which is the intersecting point of the scanning electrode and signal electrode should not change.

However, in the FLCD it is very difficult to obtain an unstable memory state perfectly, and usually, even in the panel display area, depending upon the location the area where the dark memory state is stable and the area where the bright memory state is stable are mixed, therefore, when the non-selective voltage is applied continuously to the scanning electrode and the selective voltage is not applied thereto without controlling the orientation state, the memory states of the picture elements are stabilized respectively and it is difficult to distinguish what is displayed.

SUMMARY OF THE INVENTION

It is an object of the present invention to provide a driving method for liquid crystal display device whereby a display state with little flickers and no problems in practical use can be obtained.

The invention is directed to a display control method for liquid crystal display device, in the driving method wherein a ferroelectric liquid crystal is interposed between a plurality of scanning electrodes and signal electrodes which are arranged in a direction intersecting each other, intersecting areas of the scanning electrodes and signal electrodes are formed into picture elements, a selective voltage for rewriting the picture elements on the electrode is applied to one of the scanning electrode among the plural scanning electrodes, a non-selective voltage for not rewriting the picture elements in the electrode is applied to the remaining scanning electrodes, and a signal voltage corresponding to data to be displayed by the picture elements on the scanning electrode to which the selective voltage is applied, is applied to the signal electrodes, a partial rewriting operation, whereby it is detected for every scanning electrode whether there is change in data to be displayed by the picture elements of the liquid crystal display device, the selective voltage is applied to the scanning electrodes where there is the change, and the signal voltage is applied to the signal electrodes responsive to whether the picture elements on the selected scanning electrode are changed from a bright display state to a dark display state, or changed from the dark display state to the bright display state, or the bright and dark display states are not changed, a transcribing operation, whereby the display state of all picture elements of the liquid crystal display device is rewritten at the rate of one scanning electrode for every plural adjoining scanning electrodes, and an interlaced scanning for rewriting all of the picture elements in a plurality of fields is conducted at a constant period, and securing the time for rewriting the picture elements on the scanning electrode by the partial rewriting operation, whenever the picture elements on a fixed number of scanning electrodes are transcribed by the transcribing operation, for a fixed number of scanning electrodes in advance.

According to the invention, it is possible to rewrite at the rate of one scanning electrode for every plural adjoining scanning electrodes, conduct the interlaced scanning for rewriting all picture elements in the plural fields at a constant period, apply the selective voltage to the scanning electrodes where data to be displayed by the picture elements of the liquid crystal display device has changed during the transcribing operation, and apply the signal voltage to the signal electrodes responsive to whether the picture elements on the selected scanning electrode must be changed from the bright display state to the dark display state, or must be changed from the dark display state to the bright display state, or the bright and dark display states are not changed.

Usually, in case the man watches the display picture screen, a brightness of each picture element is not recognized independently, but the brightness of a certain bulk of picture elements is recognized. Accordingly, when a display having display frequency of 30 Hz of one picture screen is used and displaying one picture screen in two fields by skipping one scanning line, the field frequency of 60 Hz may be recognized but the frame frequency of 30 Hz is hardly recognized.

Though this method is used practically in a NTSC system in television, as compared with the display means such as a CRT (Cathode-ray tube) which flashes for an instant (electron rays hit a fluorescent body) and thereafter the brightness of the fluorescent body deteriorates, in the display means such as the FLCD whose brightness changes instantly by the rewriting voltage but thereafter the brightness is retained, the flickers can be reduced largely by the interlaced scanning.

Accordingly, by increasing the field frequency of the transcribing operation above 30 Hz, even when, for example, 16 adjoining scanning electrodes are rewritten at the rate of one, the display with little flickers can be accomplished.

As described above, according to the invention, even when the FLCD having a poor display characteristic of the picture element which could not be used in the conventional driving method is used, since the picture elements are rewritten at the rate of one scanning electrode among the several adjoining electrodes, the display with little flickers can be accomplished while preventing the display deterioration of the picture elements.

The invention is directed to a display control apparatus of a ferroelectric liquid crystal device, in which a ferroelectric liquid crystal is interposed between a plurality of scanning electrodes and signal electrodes which are arranged in a direction intersecting each other, intersecting are as of the scanning electrodes and signal electrodes are formed into picture elements, a selective voltage for rewriting the picture elements on the electrode is applied to one scanning electrode among the plural scanning electrodes, a non-selective voltage for not rewriting the picture elements on the electrodes is applied to the remaining scanning electrodes, and a signal voltage corresponding to data to be displayed by the picture elements on the scanning electrode to which the selective voltage is applied, is applied to the signal electrodes, comprising;

control means which performs the partial rewriting operation, whereby when displayed by the picture elements of the liquid crystal display device, it is detected for every scanning electrode whether there is change in data, the selective voltage is applied to the scanning electrodes where there is the change, and the signal voltage is applied to the signal electrodes responsive to whether the picture elements on the selected scanning electrode are changed from a bright display state to a dark display state, or from the dark display state to the bright display state, or the bright and dark display states are not changed, and the transcribing operation, whereby the display state of all picture elements of the liquid crystal display device is rewritten at the rate of one scanning electrode for every plural adjoining scanning electrodes, and an interlaced scanning for rewriting all of the picture elements in plural fields is conducted at a fixed period, said control means securing the time for rewriting the picture elements on the scanning electrode by the partial rewriting operation, whenever the picture elements on a fixed number of scanning electrodes are transcribed by the transcribing operation, for a fixed number of scanning electrodes in advance.

In the invention, the display control apparatus of a ferroelectric liquid crystal device is characterized in that the control means includes a memory for display which stores data to be displayed next for one picture screen, a memory for discrimination which stores discrimination data indicating whether there is the change in data of the display memory for every scanning electrode in the lump, and a holding memory which stores the display state of the picture elements displayed on the liquid crystal display device for one picture screen.

in case the picture elements of the liquid crystal display device are rewritten by the interlaced scanning, data of the holding memory is used as the data to be displayed by the picture elements on the scanning electrode to which the selective voltage is applied, and in case the scanning electrode, whose data to be displayed by the picture elements of the liquid crystal display device has changed, is rewritten, the data obtained from data of the display memory and the holding memory is used as data to be displayed by the picture elements on the scanning electrode to which the selective voltage is applied, and at the same time, data of the display memory is stored in the holding memory.

Further in this invention, the display control apparatus of a ferroelectric liquid crystal device is characterized in that the control means will not store data to be displayed next in the display memory, unless all of the data, which are data of the display memory previously stored and differ from the data of the display memory stored even before, are stored in the holding memory.

It is another object of the invention to provide a display control apparatus of a ferroelectric liquid crystal panel in which one of the above-mentioned driving methods is realized.

The invention is directed to a display control apparatus of a ferroelectric liquid crystal panel wherein a ferroelectric liquid crystal is interposed between a plurality of scanning electrodes and signal electrodes which are arranged in a direction intersecting each other, intersecting areas of the scanning electrodes and the signal electrodes are formed into picture elements, a signal voltage corresponding to display data is applied to the signal electrodes, a selective voltage capable of rewriting the display state of the picture elements on the electrode is applied one after another to the scanning electrodes, and while the selective voltage is applied again, at the timing of applying the selective voltage, a non-selective voltage which can not rewrite the display state of the picture elements is applied repetitively to the other scanning electrodes, the display control apparatus comprising;

a frame memory for display data for storing the display data of one picture screen to be displayed by the picture elements in the next frame;

a frame memory for difference data for storing the difference data of one picture screen showing the difference between display data displayed at present and display data stored in the frame memory for display data;

a line memory for storing line discrimination data which are corresponding to the scanning electrodes and indicate whether or not there is even one data showing the difference in the difference data of the frame memory for difference data corresponding to the picture elements on the scanning electrode;

scanning electrode selective means for checking, while the selective voltage is applied to the scanning electrode, line discrimination data of the line memory corresponding to the scanning electrodes following the scanning electrode one after another, deciding to apply the selective voltage to the corresponding scanning electrode when the line discrimination data is the data showing the difference, and deciding to apply the selective voltage to the predetermined scanning electrode for every frame regardless of the content of line discrimination data; and data output means for giving, in response to display data of the frame memory for display data and difference discrimination data of the frame memory for difference data, control data corresponding to the picture elements of the scanning electrode which is decided to be selected by the scanning electrode selective means, to the signal electrode side of the ferroelectric liquid crystal panel in synchronism with the selection of the scanning electrode.

According to the invention, in case of the ferroelectric liquid crystal panel having m scanning electrodes, when the number of scanning electrodes in which display data displayed, at present, by the picture elements thereof differ from display data to be displayed in the next frame is q, as to the remaining scanning electrodes (m-q) where there is no difference in display data, the selective voltage is applied only to some of the scanning electrodes, so that even when selecting p scanning electrodes out of the remaining (m-q) scanning electrodes, the selective voltage is not applied to (m-q-p) scanning electrodes in one frame, thus the display control apparatus for realizing a driving method whereby the response time from input to display on the picture screen is shortened can be obtained.

BRIEF DESCRIPTION OF THE DRAWINGS

Other end further objects features, and advantages of the invention will be more explicit from the following detailed description taken with reference to the drawings wherein:

FIG. 5 is a waveform diagram showing the output signal from a personal computer in the display control apparatus wherein:

FIG. 5(1) is a horizontal synchronizing signal HD-,

FIG. 5(2) is a vertical synchronizing signal,

FIG. 5(3) illustrates the information as display data, "Data",

FIG. 5(4) is a wavelength diagram showing an expanded horizontal scanning interval of the horizontal synchronizing signal HD-.

FIG. 5(5) is a waveform diagram showing an expanded horizontal scanning interval of the display date, and FIG. 5(6) is a waveform diagram showing a data transfer clock of the display data for each picture element, FIG. 7 and FIG. 8 are waveform diagrams showing respective impressed voltages used for driving a ferroelectric liquid crystal panel in the display control apparatus, wherein:

FIG. 7(1) and FIG. 8(1) illustrate, for two different embodiments, selective voltage VCa which is applied to the selected scanning electrode, FIG. 7(2) and FIG. 8(2) illustrate non-selective voltage VCb which is applied to non-selected scanning electrodes, FIG. 7(3) and FIG. 8(3) illustrate bright rewriting voltage VSc which is applied to signal electrodes to rewrite picture elements into a "bright" state, FIG. 7(4) and FIG. 8(4) illustrate dark rewriting voltage VSd which is applied to signal electrodes to rewrite picture elements into a "dark" state, FIG. 7(5) and FIG. 8(5) illustrate non-rewriting voltage VSg applied to the signal electrodes, FIGS. 7(6) to 7(11) and FIGS. 8(6) to 8(11) illustrate, respectively, waveforms of the effective voltage applied to the picture element $A_{ij}$, FIG. 9 and FIG. 10 are waveform diagrams showing output signals from a control circuit in the display control apparatus, wherein:

FIG. 9(1) and FIG. 10(1) illustrate waveform diagrams for a clock for sequentially transferring the selective signal in a shift register, FIG. 9(2) and FIG. 10(2) illustrate waveform diagrams for a selective signal;

FIG. 9(3) and FIG. 10(3) illustrate display data corresponding to picture elements of a ferroelectric liquid crystal display device, FIG. 9(4) and FIG. 10(4) illustrate wavelength diagrams for a clock that takes in and holds the selective signal in a shift register, FIG. 9(5) illustrates a waveform diagram of an expanded clock time period for sequential transferring of the selective signal, FIG. 9(6) illustrates a waveform diagram for the expanded selective signal for the time period of FIG. 9(5), FIG. 9(7) illustrates a waveform diagram for expanded display data for the time period of FIG. 9(5), FIG. 9(8) illustrates a waveform diagram for data transfer clock for sequentially transferring display data in a shift register, FIG. 9(9) illustrates a waveform diagram for latch pulse for timing for taking in and building display data in a shift register, FIG. 9(10) illustrates a waveform diagram for voltages VCa and VCb applied to scanning electrodes, and FIG. 9(11) illustrates a waveform diagram for voltages VSc, VSd and VSg applied to signal electrodes, FIG. 14 is a waveform diagram showing respective voltages applied to several scanning electrodes, signal electrodes and picture elements of the conventional ferroelectric liquid crystal panel, wherein:

FIG. 14(1) illustrates a waveform of a transfer clock of the selective signal in a shift register in the scanning side driving circuit, FIG. 14(2) illustrates a waveform of the selective signal, FIG. 14(3) illustrates an impressed voltage waveform to the scanning electrode, L1, FIG. 14(4) illustrates an impressed voltage waveform to the scanning electrode, L2, FIG. 14(5) illustrates the impressed voltage waveform to the scanning electrode 13, FIG. 14(6) illustrates the impressed voltage waveform to the signal electrode, S5, FIG. 14(7) illustrates the impressed voltage waveform to signal electrode, S6, FIG. 14(8) illustrates the effective voltage waveform to picture element A15, FIG. 14(9) illustrates the effective voltage waveform to picture element A16, FIG. 14(10) illustrates the effective voltage waveform to picture element A25, and FIG. 14(11) illustrates the effective voltage waveform to picture element A26, FIG. 31 is a waveform diagram showing a voltage applied to a ferroelectric liquid crystal panel from a internal clock generating circuit and a transmission light quantity, and FIG. 32, FIG. 33 and FIG. 34 are waveform diagrams showing respective voltages applied to several scanning electrodes, signal electrodes and picture elements of the second ferroelectric liquid crystal panel of the invention.

DETAILED DESCRIPTION OF THE PREFERRED EMBODIMENTS

Figure 1:
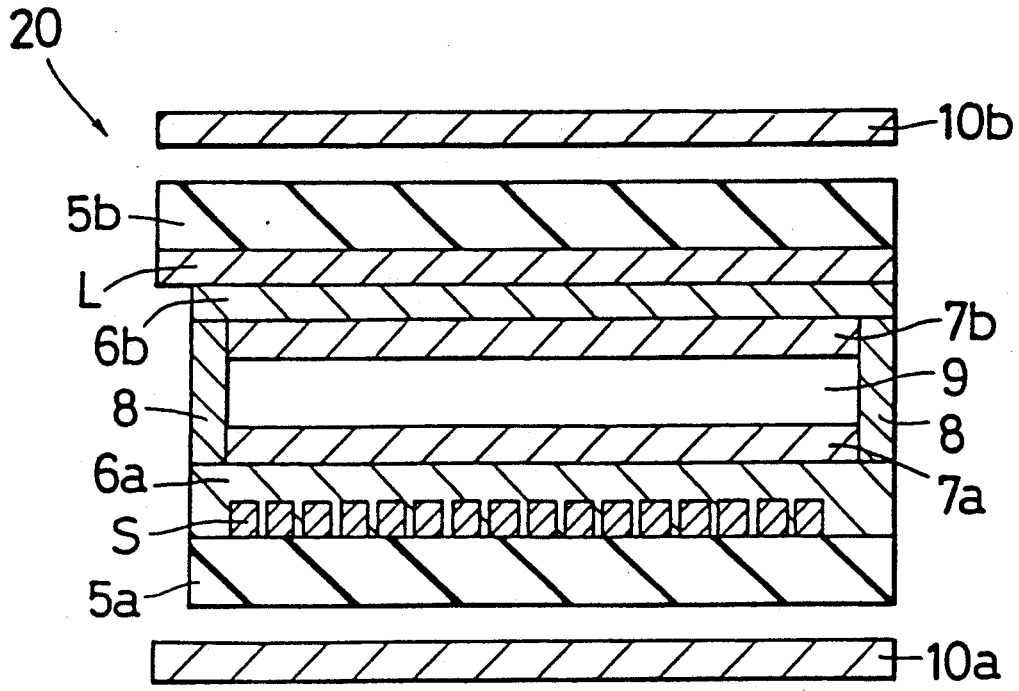
Fig. 1 PRIOR ART
FIG. 1 is a sectional view showing a configuration of a ferroelectric liquid crystal panel used in a ferroelectric liquid crystal display utilized in a display control apparatus of the invention.

Now referring to the drawing, preferred embodiments of the invention are described below. "First Embodiment"

Figure 15:
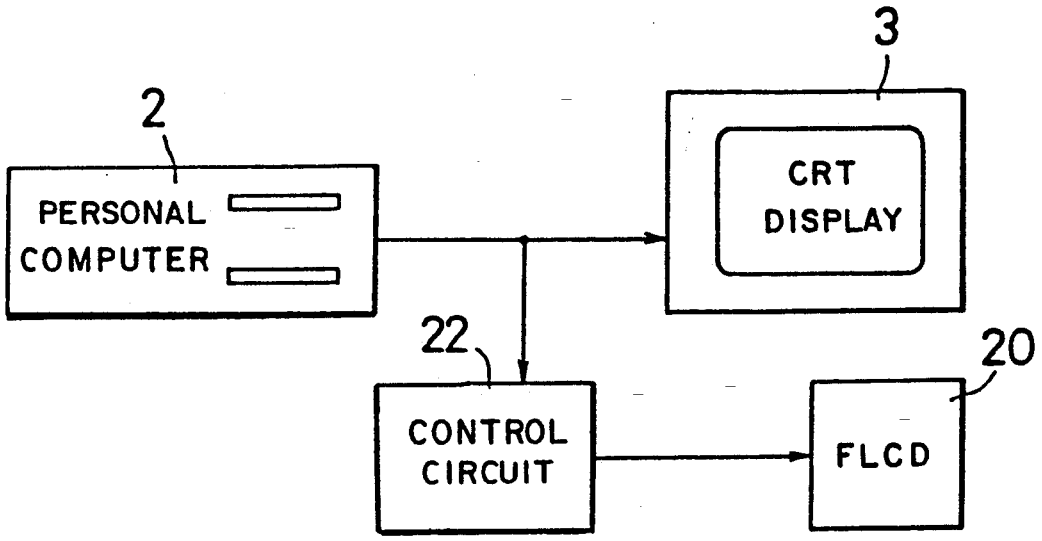
FIG. 15 is a block diagram showing a schematic configuration of a display system using a display control apparatus of the invention.

FIG. 15 is a block diagram schematically showing a configuration of display device wherein a driving method which is one embodiment of the invention is applied. The configuration of the display device is schematically same as that of the conventional example, in which information necessary for the image display is obtained from a digital signal outputted to a CRT display 3 from a personal computer 2, and the digital signal is transformed into a drive signal for image display by an FLCD 20 in a control circuit 22, thereby the image display is accomplished on the FLCD 20.

Figure 5:
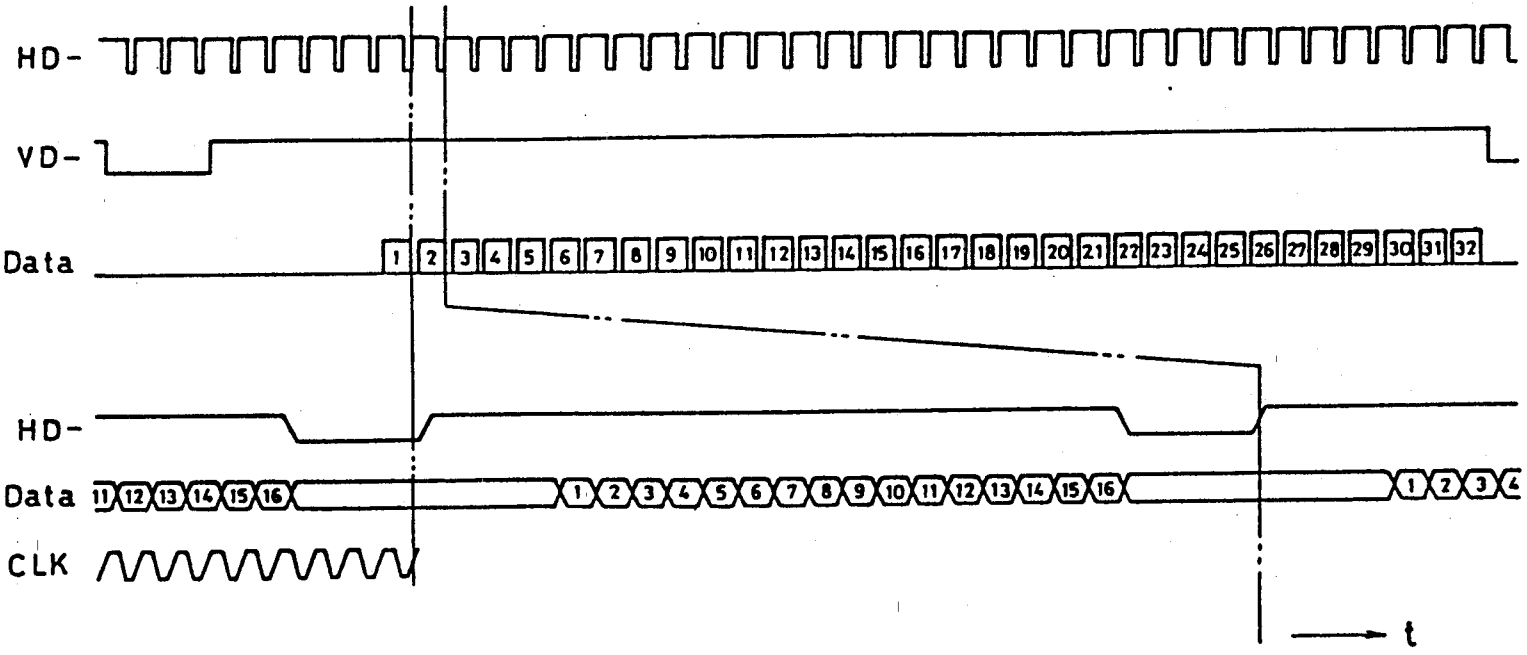
Figure 6:
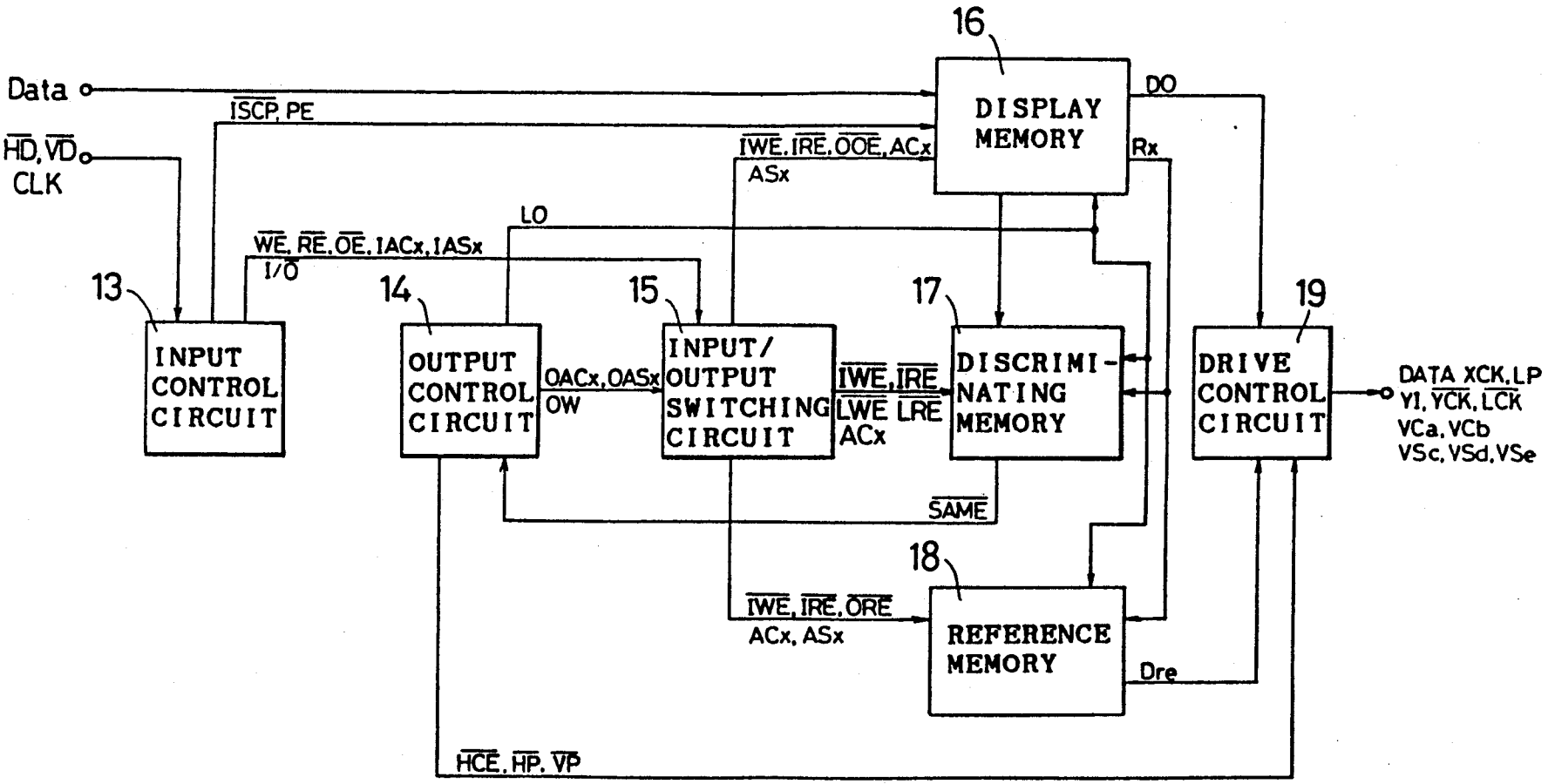
Fig. 6 Prior Art
FIG. 6 is a block diagram showing a schematic configuration of a control circuit in a conventional display control apparatus.

The digital signal outputted to the control circuit 22 from the personal computer 2 is the signal shown in FIG. 5 as same as the conventional example.

FIG. 1 is a sectional view showing a schematic configuration of the FLCD 20. Two sheets of glass substrate 5a, 5b are disposed in opposition to each other. A signal electrode S consisting of indium tin oxide (hereinafter abbreviated as ITO) is arranged plurally in parallel on the surface of one glass substrate 5a, and covered by a transparent insulating film 6a consisting of $SiO_2$ thereon. On the surface of the other glass substrate 5b opposing to the signal electrode S, a scanning electrode L consisting of ITO is arranged plurally in parallel in a direction orthogonal to the signal electrode S, and covered by a transparent insulating film 6b consisting of $SiO_2$ thereon.

On the insulating films 6a, 6b, orientation films 7a, 7b consisting of polyvinyl alcohol and treated by rubbing processing are formed respectively. The two glass substrates 5a, 5b are bonded together with a sealing agent 8 partially leaving an injection port, which is sealed by the sealing agent 8 after an FLC 9 is introduced into a space between the orientation film 7a, 7b by the vacuum injection therethrough.

The two glass substrates 5a, 5b thus bonded together are clamped between two polarizing plates 10a, 10b which are arranged such that respective polarizing axes intersect orthogonally. In the FLCD 20 of the embodiment, a polyimide resin treated by rubbing is used as the orientation films 7a, 7b, and as a ferroelectric liquid crystal ZLI-4237/000 by Melk Corp. is used.

Figure 2:
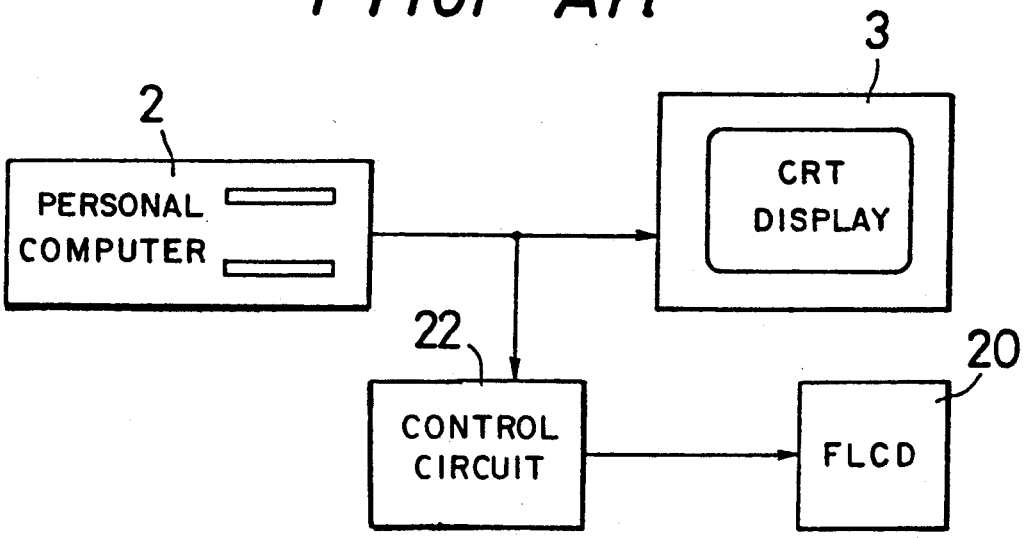
Fig. 2 Prior Art
FIG. 2 is a block diagram showing a schematic configuration of a conventional display control apparatus.
Figure 16:
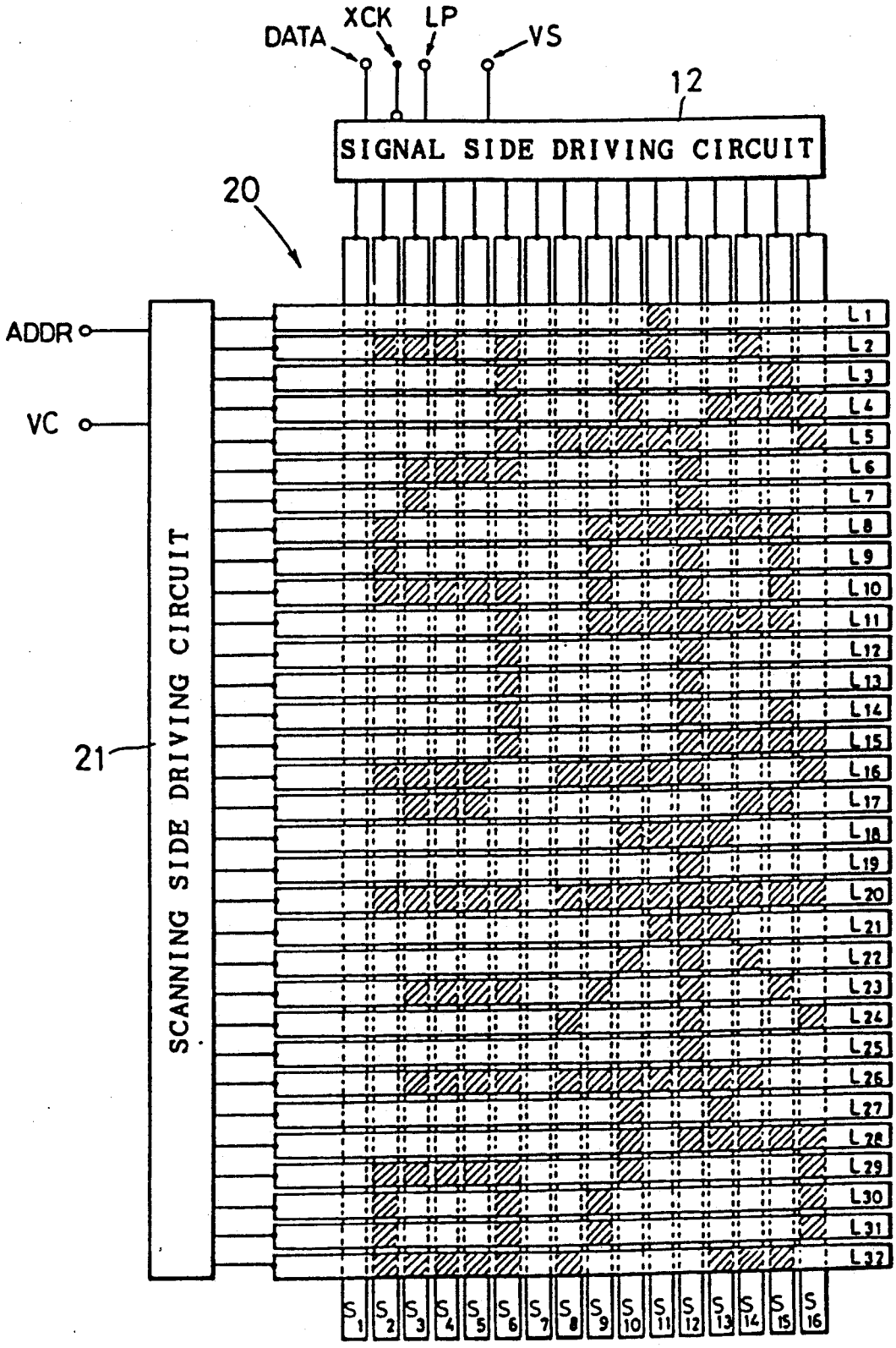
FIG. 16 is a view showing a display state of Japanese characters meaning "FERROELECTRIC" on the ferroelectric liquid crystal display used in the first display control apparatus.

FIG. 16 is a plan view showing a configuration of the FLCD 20, in which a scanning side driving circuit 21 is connected to the scanning electrode L of an FLC panel having a Simplex Matrix Configuration, and a signal side driving circuit 12 is connected to the signal electrode S. The scanning side driving circuit 21 is for applying voltages to the scanning electrode L, and the signal side driving circuit 12 is for applying voltages to the signal electrode S. That is, there is only the difference in configuration of the scanning side driving circuit between the FLCD 20 and the FLCD 1 of FIG. 2.

Figure 17:
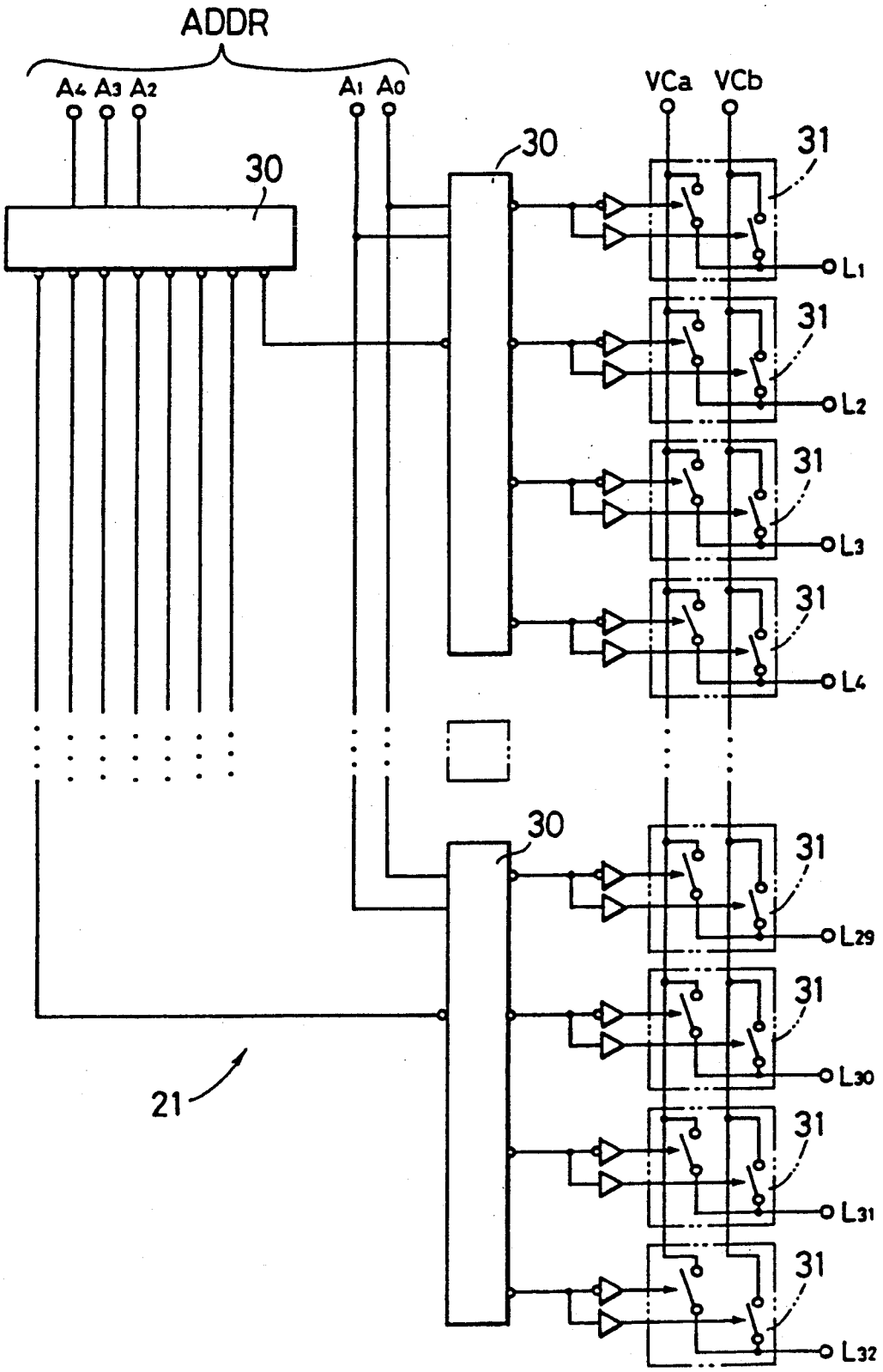
FIG. 17 is a circuit diagram showing a schematic configuration of a scanning side driving circuit used in the ferroelectric liquid crystal display.

FIG. 17 is a circuit diagram showing a schematic configuration of the scanning side driving circuit 21 used in the aforesaid FLCD 20. The scanning side driving circuit 21 is constituted by one 8-line decoder, eight 4-line decoders and 32 sets of 2-voltage switching analog switches. The scanning side driving circuit 21, whose input signals are an address signal ADDR, a selective voltage VCa and a non-selective voltage VCb, applies the selective voltage VCa to the scanning electrode Li corresponding to the value of the address signal ADDR, and applies the non-selective voltage VCb to the other scanning electrodes Lk ($k \neq i$, $i=1$ to 32).

Figure 18:
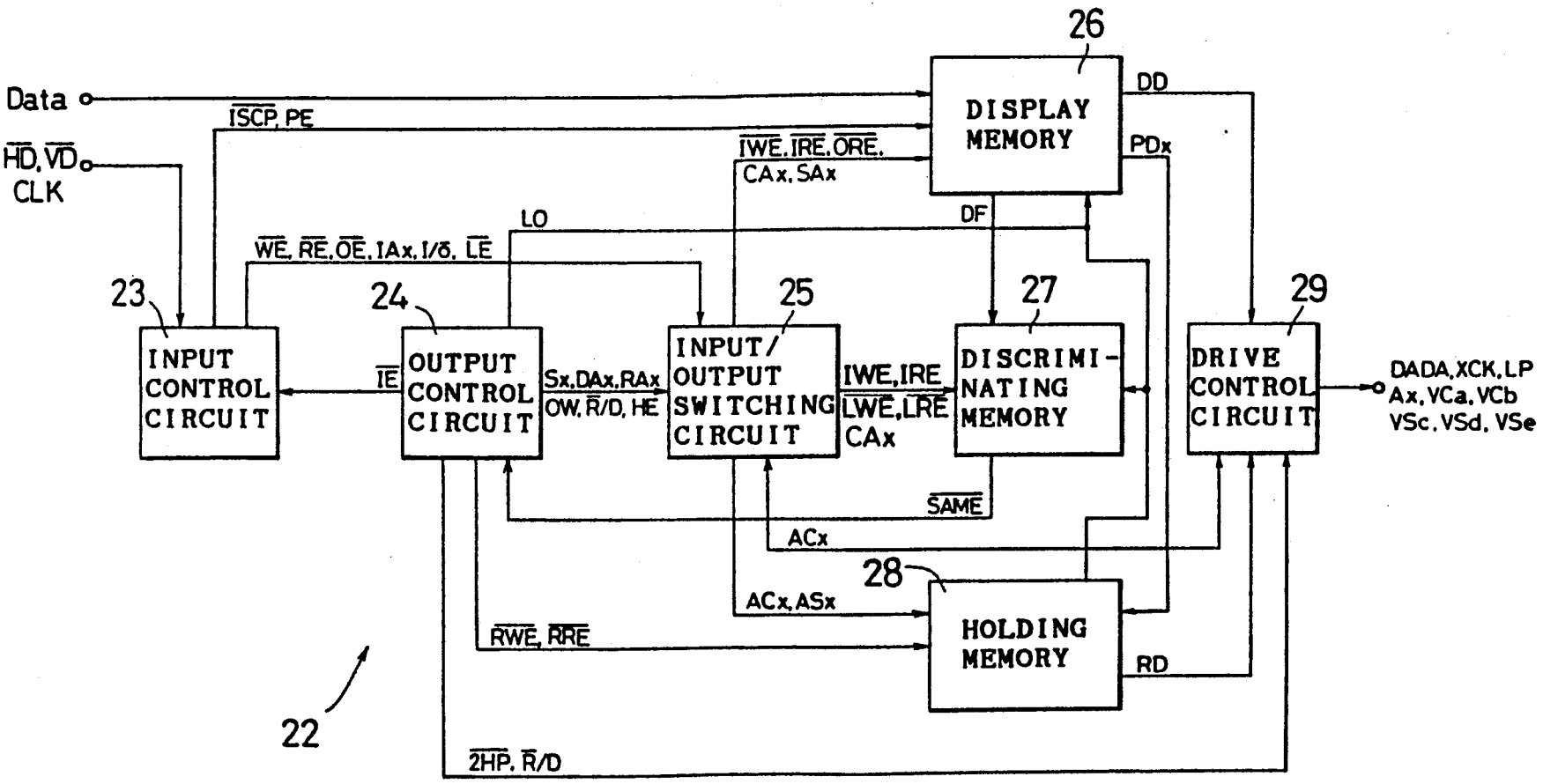
FIG. 18 is a block diagram showing a schematic configuration of a first control circuit in the first display control apparatus of the invention.

FIG. 18 is a block diagram schematically showing a configuration of the control circuit 22 abovementioned used in the display control apparatus of the invention, and FIG. 5 is a waveform diagram of the signals outputted to the CRT display 3 from the personal computer 2 stated above. FIG. 5 (1) is a horizontal synchronizing signal HD- which gives a period of one horizontal scanning interval of image information outputted to the CRT display 3, FIG. 5 (2) is a vertical synchronizing signal VD- which gives a period of one picture screen of the information and FIG. 5 (3) is a view wherein the information is shown in the lump for every horizontal scanning interval as display data Data, index numerals corresponding to the scanning electrodes Li of the FLCD 20.

FIG. 5 (4) is a waveform diagram showing expanded one horizontal scanning interval of the horizontal synchronizing signal HD-, FIG. 5 (5) is a waveform diagram showing expanded one horizontal scanning interval of the display data Data, index numerals corresponding to the signal electrodes Sj of the FLCD 20, and FIG. 5 (6) is a waveform diagram showing a data transfer clock CLK for every picture element of the display data Data.

A display memory 26 is a memory for storing display data Data of one picture screen outputted from the personal computer 2 of FIG. 15 when necessary. From the display memory 26, displacement data DF showing the difference between data displayed, at present, on the FLCD 20 and display data to be displayed on the next frame (i.e. display data just to be written into the display memory 26), is outputted to a discriminating memory 27, and the display data stored in the display memory 26 is outputted to the drive content circuit 29 as data DD and to a holding memory 28 as data PDx.

The discriminating memory 27 is the memory for storing, in response to the displacement data DF outputted from the display memory 26, whether or not there is even one picture element on the scanning electrode of the FLCD 20 where the display data displayed at present differs from the display data to be displayed in the next frame, as discrimination data for every scanning electrode. In the discriminating memory 27, one-bit memory capacity is allocated respectively for storing the discrimination data for every scanning electrode, the discrimination data SAME- being outputted to an output control circuit 24.

The holding memory 28 is the memory for holding one picture screen of display data which is same as the display data displayed, at present, on the FLCD 20, and for storing the display data PDx including information which is same as the display data DD outputted from the display memory 26 to the drive control circuit 29, after outputting hold data RD to the drive control circuit 29.

An input control circuit 23 is a circuit for controlling, in response to the horizontal synchronizing signal HD-, vertical synchronizing signal VD- and clock CK outputted from the personal computer 2, the input side operation of the display memory 26, discriminating memory 27 and holding memory 28 directly or indirectly through an input/output switching circuit 25.

The output control circuit 24 is the circuit which controls, in response to the discrimination data SAME- outputted from the discriminating memory 27 and the internal clock CK, the output side operation of the display memory 26, discriminating memory 27 and holding memory 28 directly or indirectly through the input/output switching circuit 25, and at the same time, indicates a display position of display data DATA outputted from the drive control circuit 29 on the FLCD 20.

The input/output switching circuit 25 in the circuit which switches, in response to the signals of the input control circuit 23 and output control circuit 24, input- /output control signals applied to the display memory 26, discriminating memory 27 and holding memory 28.

The drive control circuit 29 is the circuit which outputs image data DATA in the basis of the display data DD given from the display memory 26 and the hold data RD given from the holding memory 28, and in response to signal given from the output control circuit 24, outputs the signal which gives a position of the image data DATA in the FLCD 20, selective voltage VCa, non-selective voltage VCb, non-rewriting voltage VSg, dark rewriting voltage VSd and bright rewriting voltage VSc to the FLCD 20.

Figure 7:
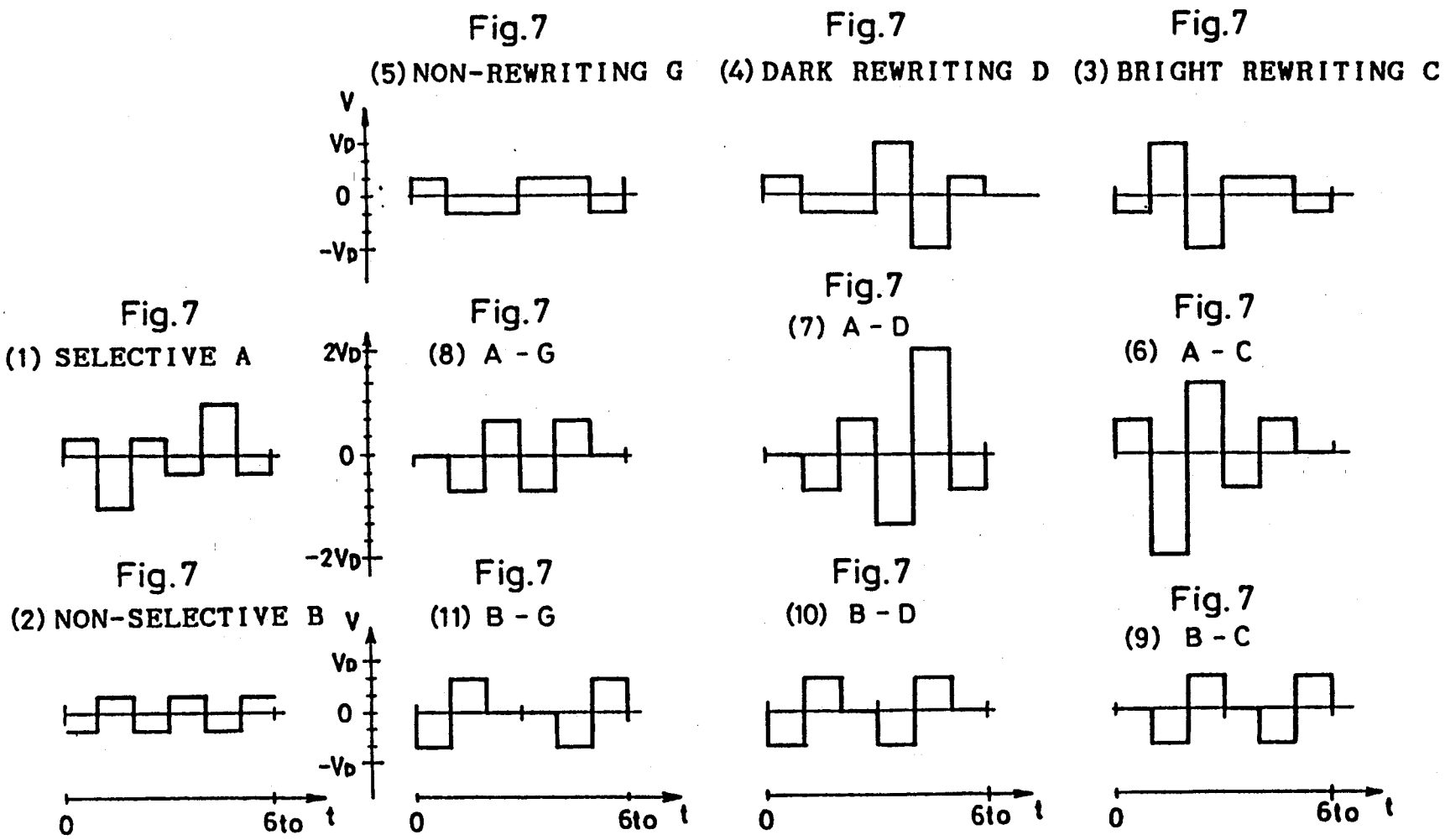
Figure 8:
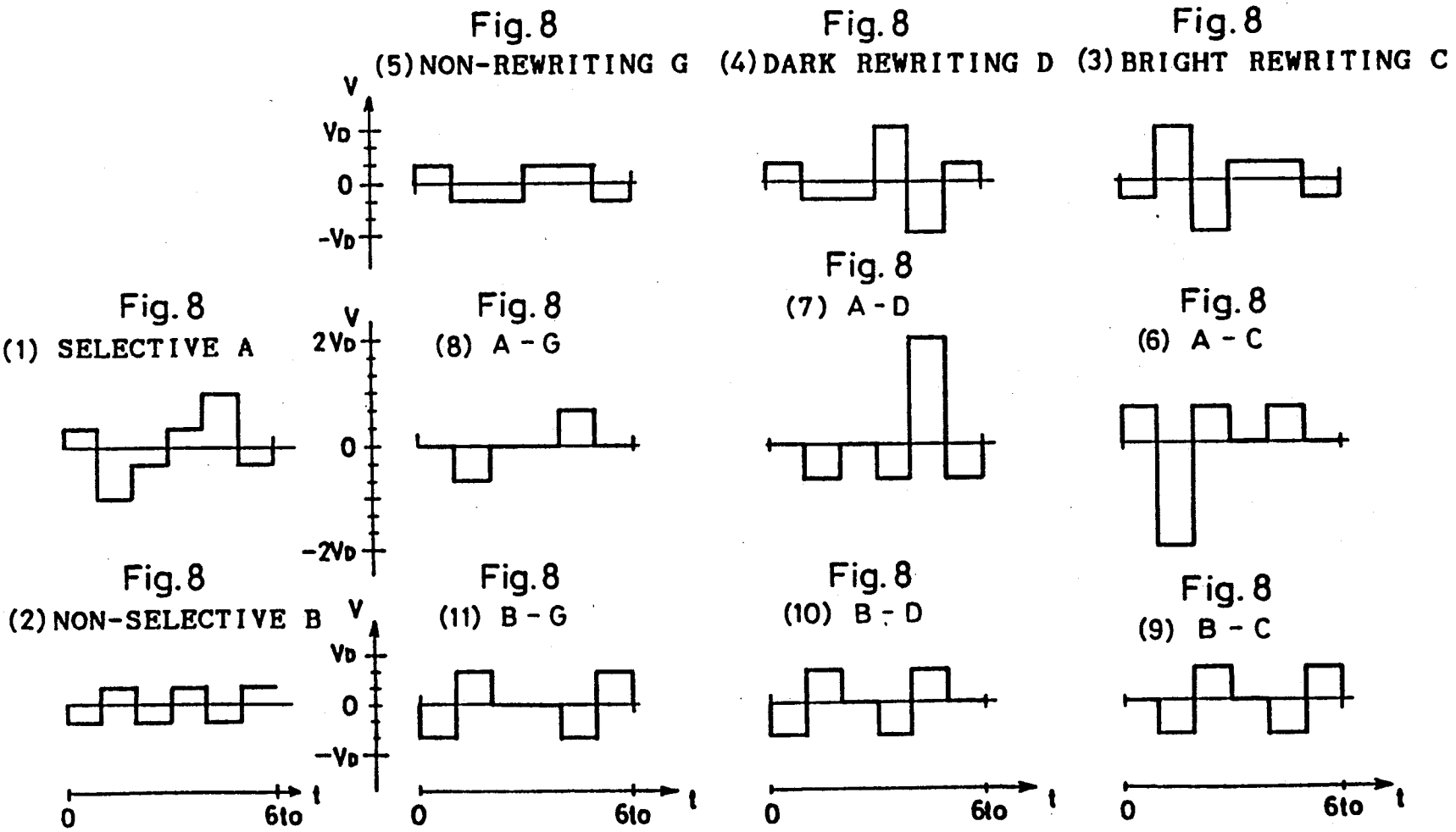
Figure 9:
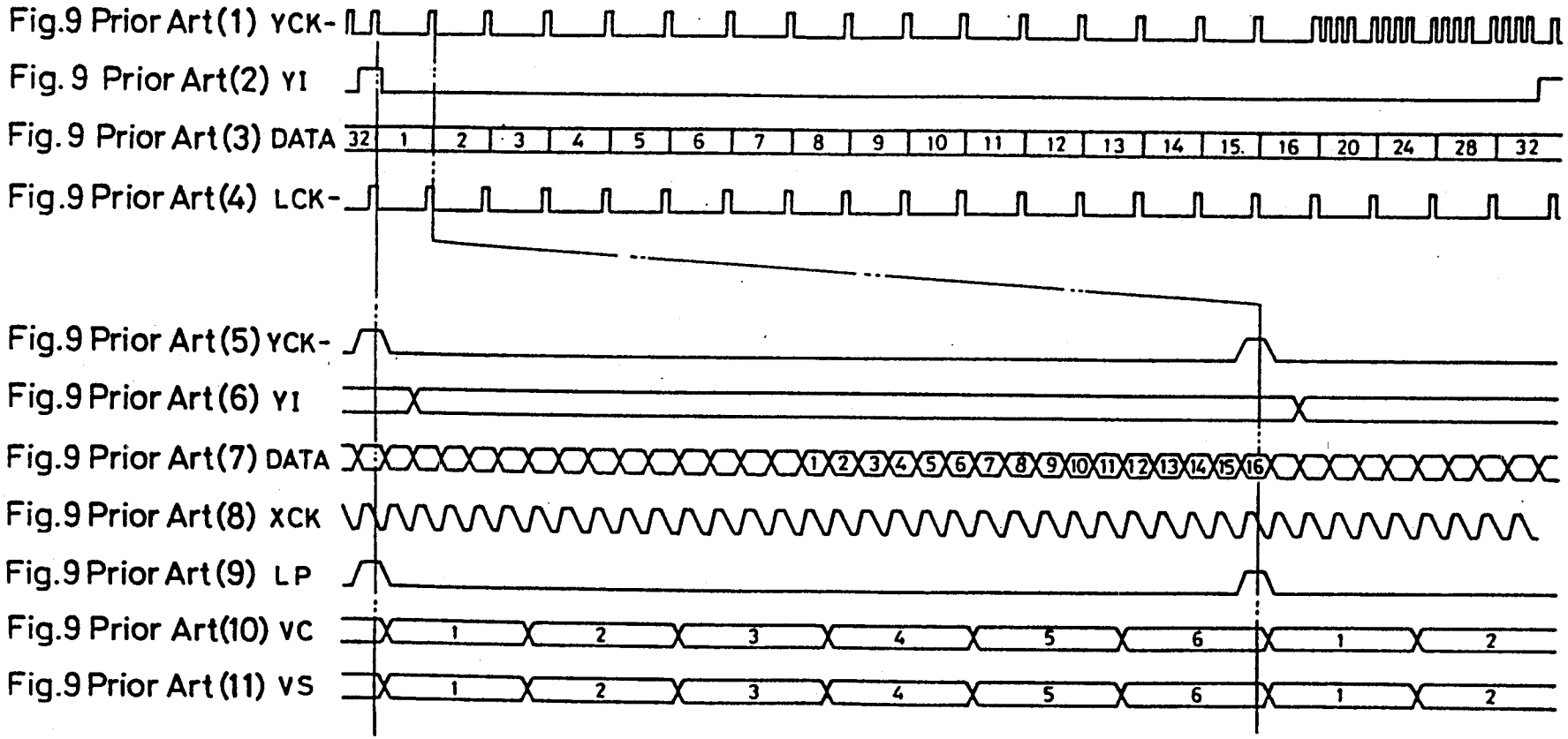
Figure 10:
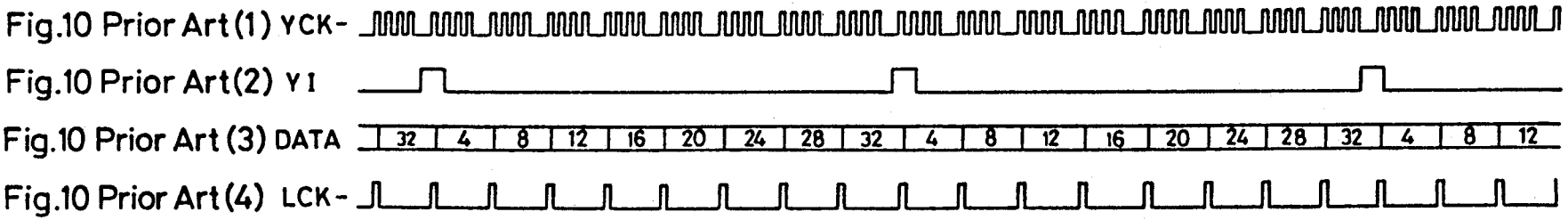

Specific voltage waveforms of the selective voltage VCa and non-selective voltage VCb applied to the scanning electrode L, and the non-rewriting voltage VSg, dark rewriting voltage VSd and bright rewriting voltage VSc applied to the signal electrode S are shown in FIG. 7 and FIG. 8.

FIG. 7 and FIG. 8 shows the specific voltage waveforms of the selective voltage VCa and non-selective voltage VCb applied to the scanning electrode L, and the non-rewriting voltage VSg, dark rewriting voltage VSd and bright rewriting voltage VSc applied to the signal electrode S. A waveform shown in FIG. 7 (1) and FIG. 8 (1) is the selective voltage VCa which is applied to the scanning electrode L for rewriting the memory state of the picture elements on the scanning electrode L or the luminous state displayed, and a waveform shown in FIG. 7 (2) and FIG. 8 (2) is the non-selective voltage VCb a which is applied to the other scanning electrodes L for not rewriting the display state of the picture elements on the scanning electrodes L.

A waveform shown in FIG. 7 (5) and FIG. 8 (5) is the non-rewriting voltage VSg which is applied to the signal electrode S for not rewriting the display state of the picture elements on the scanning electrode L to which the selective voltage VCa is applied, a waveform shown in FIG. 7 (4) and FIG. 8 (4) is the dark rewriting voltage VSd which is applied to the signal electrode S for rewriting the display state of the picture elements on the scanning electrode L to which the selective voltage VCa is applied, into the "dark" luminous state, and a waveform shown in FIG. 7 (3) and FIG. 8 (3) is the bright rewriting voltage VSc which is applied to the signal electrode S for rewriting the display state of the picture elements on the scanning electrode L to which the selective voltage VCa is applied, into the "bright" luminous state.

FIG. 7 (6) and FIG. 7 (11) and FIG. 8 (6) to FIG. 8 (11) show waveforms of the effective voltage applied to the picture element Aij. A waveform A-G of FIG. 7 (8) and FIG. 8 (8) shows the voltage waveform applied to the picture element Aij, when the selective voltage VCa is applied to the scanning electrode Li and the non-rewriting voltage VSg is applied to the signal electrode Sj, a waveform A-D of FIG. 7 (7) and FIG. 8 (7) shows the voltage waveform applied to the picture element Aij, when the selective voltage VCa is applied to the scanning electrode Li and the dark rewriting voltage VSd is applied to the signal electrode Sj, a waveform A-C of FIG. 7 (6) and FIG. 8 (6) shows the voltage waveform applied to the picture element Aij, when the selective voltage VCa is applied to the scanning electrode Li and the bright rewriting voltage VSc is applied to the signal electrode Sj, a waveform B-G of FIG. 7 (11) and FIG. 8 (11) is the voltage waveform applied to the picture element Aij, when the non-selective voltage VCb is applied to the scanning electrode Li and the non-rewriting voltage VSg is applied to the signal electrode Sj, a waveform B-D of FIG. 7 (100 and FIG. 8 (10) is the voltage waveform applied to the picture element Aij, when the non-selective voltage VCb is applied to the scanning electrode Li and the dark rewriting voltage VSd is applied to the signal electrode Sj, and a waveform B-C of FIG. 7 (9) and FIG. 8 (9) is the voltage waveform applied to the picture element Aij, when the non-selective voltage VCb is applied to the scanning electrode Li and the bright rewriting voltage VSc is applied to the signal electrode Sj.

Figure 3:
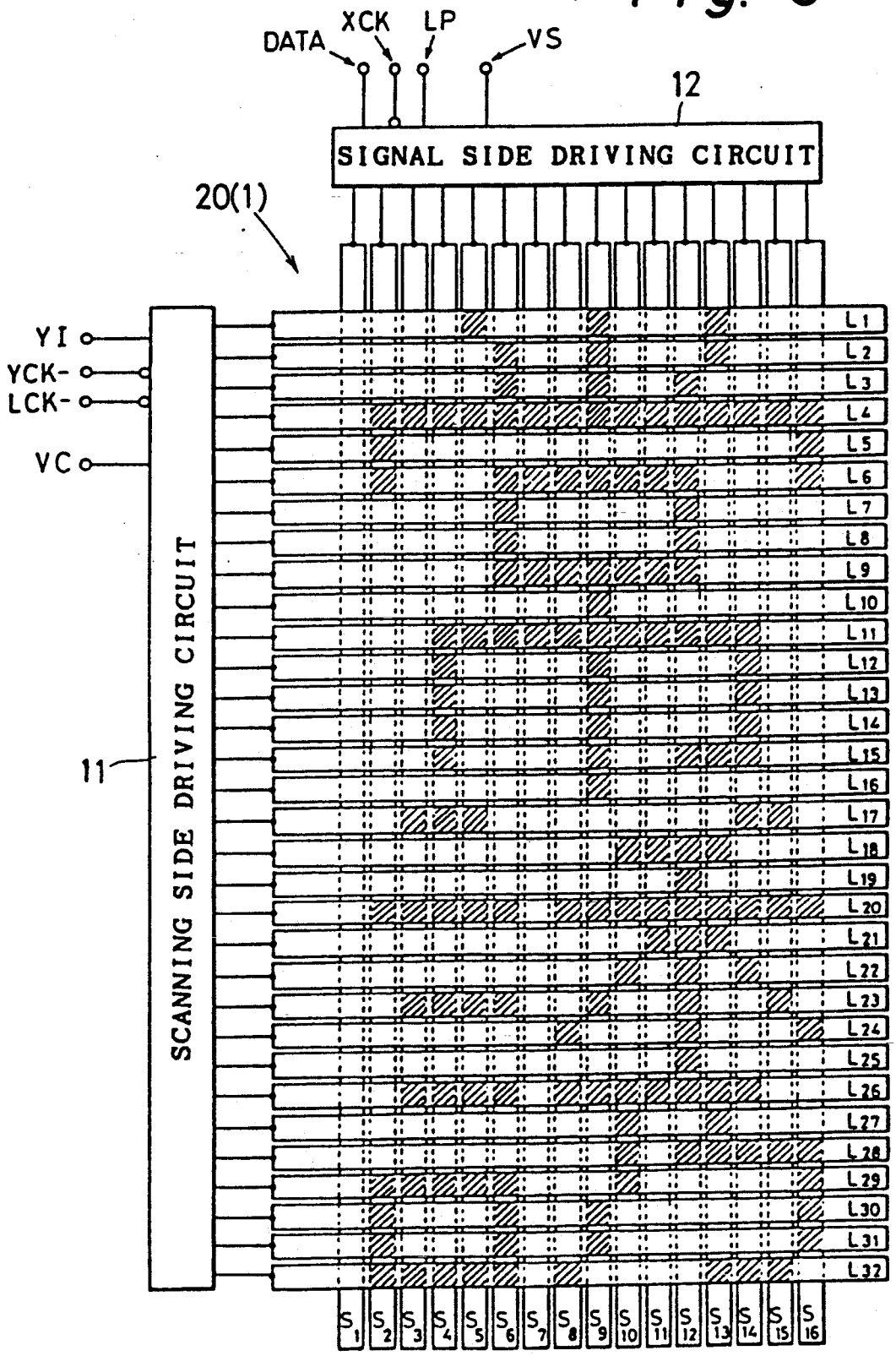
FIG. 3 is a view showing a display state of Japanese characters meaning "ORDINARY DIELECTRIC" on a ferroelectric liquid crystal display.
Figure 19:
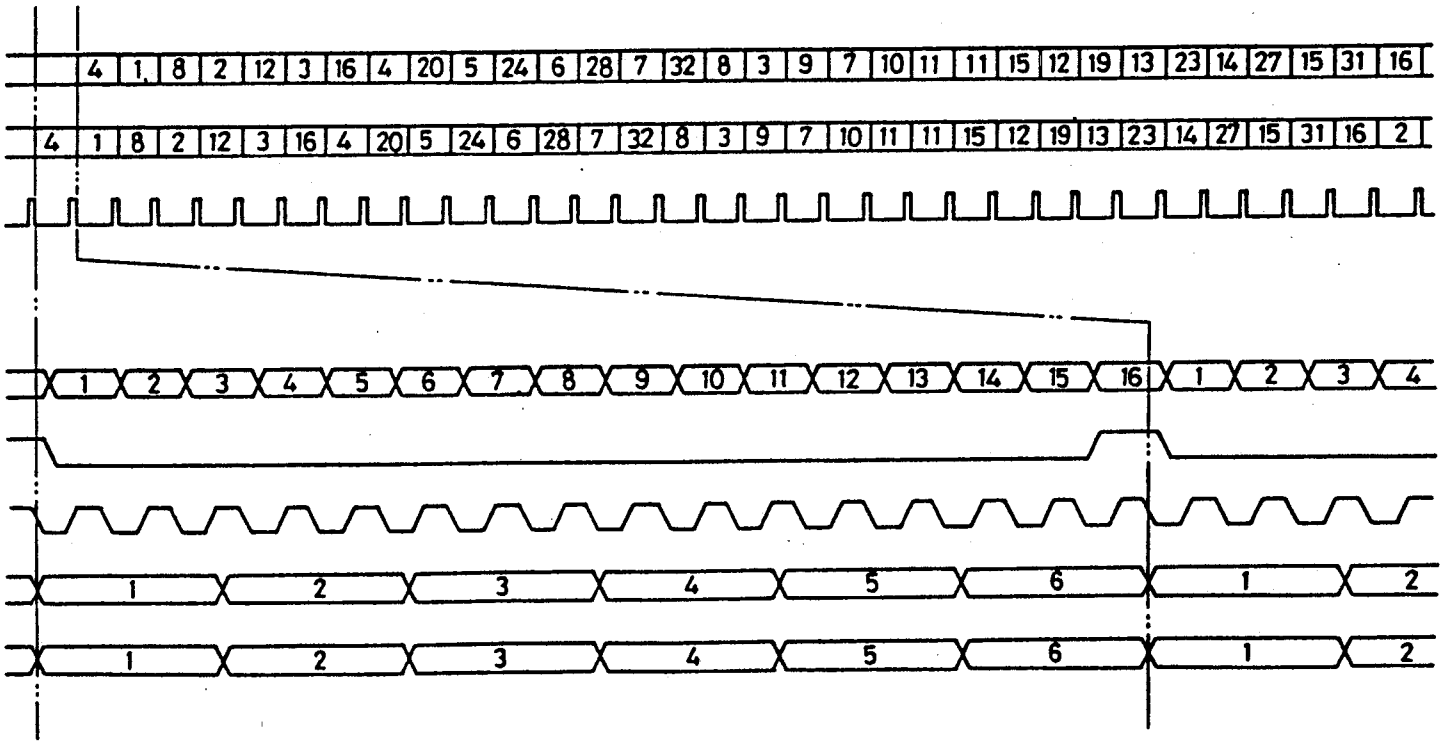
FIG. 19 and FIG. 20 are waveform diagrams showing output signals from the first control circuit in the first display control apparatus.
Figure 20:
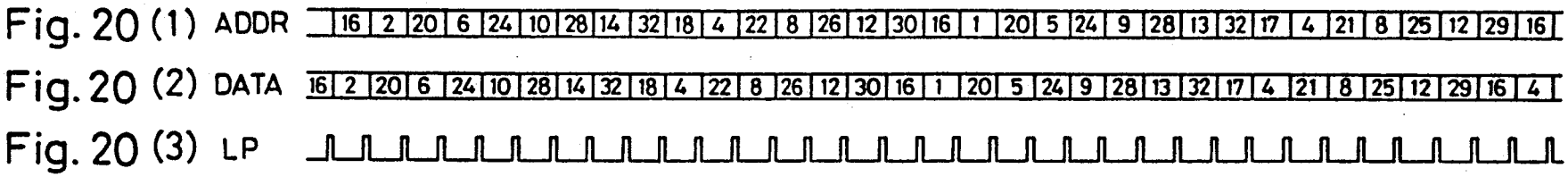

FIG. 19 and FIG. 20 are waveform diagrams showing a drive signal outputted to the FLCD 20 from the control circuit 22, in case the display state of Japanese characters meaning "FERROELECTRIC" of the picture elements Aij of the FLCD 20 shown in FIG. 16, is rewritten into Japanese characters meaning "ORDINARY DIELECTRIC" same as the display state of the picture elements Aij of the FLCD 20 shown in FIG. 3, by the driving method of the invention by using the control circuit 22 of FIG. 18 abovementioned. FIG. 19 (2) and FIG. 20 (2) show display data DATA corresponding to the picture elements of the FLCD 20, FIG. 19 (3) and FIG. 20 (3) show a latch pulse LP which gives the timing for taking and holding the display data DATA in a shift register, not shown, included in the signal side driving circuit 12, in a separate register, not shown, included in the signal side driving circuit 12, and FIG. 19 (1) and FIG. 20 (1) are waveform diagrams showing a scanning electrode address ADDR for applying the selective voltage VCa to the scanning electrode Li of the FLCD 20 corresponding to the display data DATA held in the register abovementioned.

FIG. 19 (4) is a waveform diagram showing the display data DATA expanded for one selective time, FIG. 19 (5) is a waveform diagram showing the latch pulse LP expanded for one selective time, FIG. 19 (6) is a waveform diagram showing a data transfer clock XCK for transferring sequentially the display data DATA, in a shift register, not shown included in the signal side driving circuit 12, FIG. 19 (7) is a waveform diagram schematically showing the voltages VCa, VCb applied to the scanning electrode L and FIG. 19 (8) is a waveform diagram schematically showing the voltages VSc, VSd, VSg applied to the signal electrodes S. FIG. 20 (1) to FIG. 20 (3) show the waveforms following the waveforms of FIG. 19 (1) to FIG. 19 (3).

When describing the driving method of the invention according to the waveform diagrams shown in FIG. 19 and FIG. 20, in a frame in which Japanese characters meaning "FERROELECTRIC" are displayed on the picture screen of the FLCD 20, display data stored in the display memory 26 and the holding memory 28 is the state of picture elements of 32×16 itself in FIG. 16, and discrimination data stored in the discriminating memory 27 are all "0".

Figure 11:
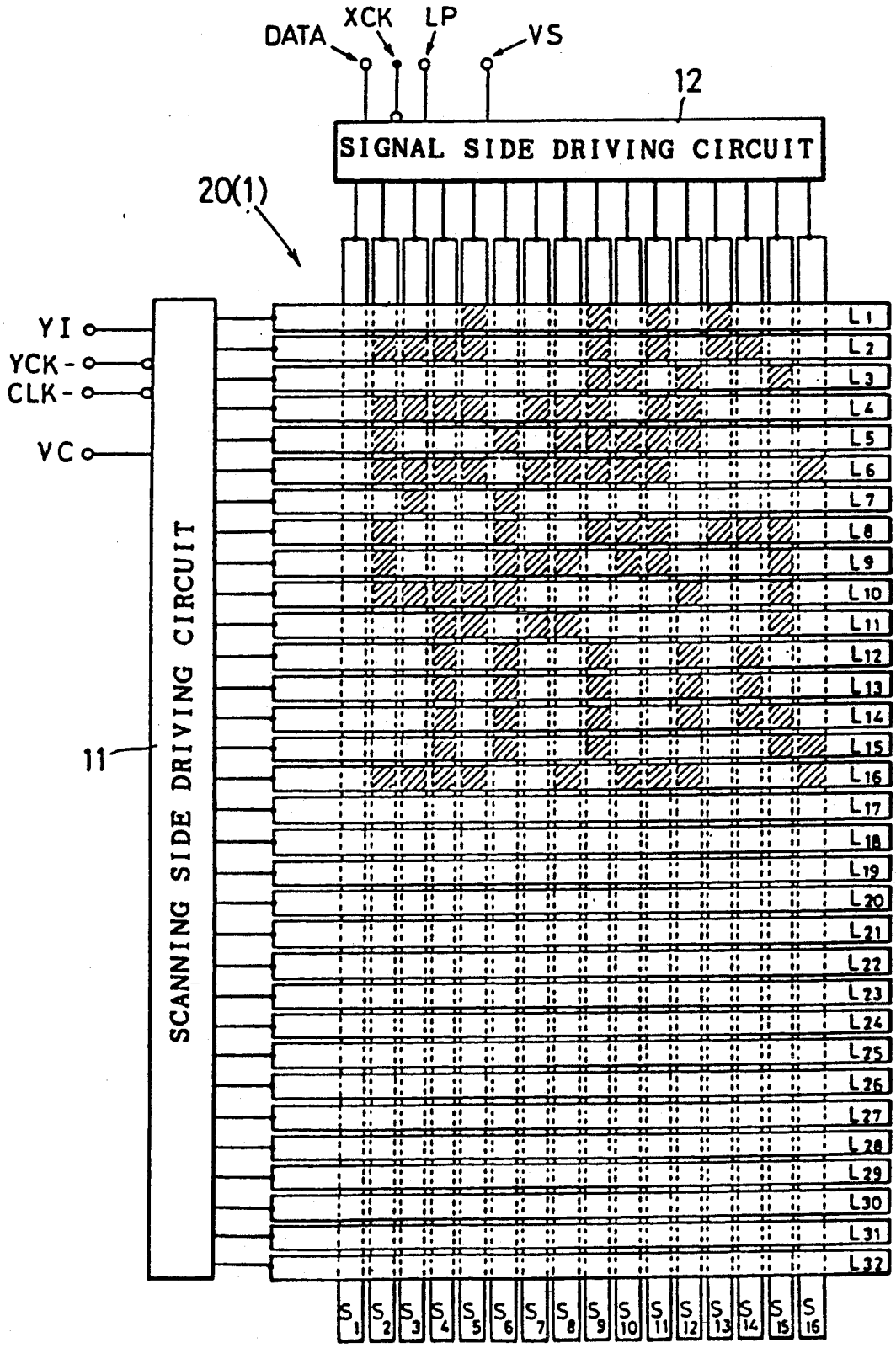
FIG. 11 is a view schematically showing an example of transformation data stored in a reference memory in a control circuit.

Under this state, display data DATA displaying Japanese characters meaning "ORDINARY DIELECTRIC" are transmitted to the display memory 26 from the personal computer 2. At this time, it is preferable to confirm that all of the discrimination data stored in the discriminating memory 27 are "0", and to allow the display data DATA "ORDINARY DIELECTRIC" to be inputted to the display memory 26, thereby displacement data DF of one picture screen which is the difference of "FERROELECTRIC" and "ORDINARY ELECTRIC" and shown schematically in FIG. 11 is sent to the discriminating memory 27 from the display memory 26. The displacement data DF for one scanning electrode is stored in the discriminating memory 27 in the lump. That is, "1" is held from the scanning electrodes L1 to L16, and "0" is held from the scanning electrodes L17 to L32.

Waveforms shown in FIG. 19 and FIG. 20 illustrate the operation thereafter, in which, first, the transcribing operation of the scanning electrode L4 is started. From the output control circuit 24, an output side line address ACx "4" is outputted to the holding memory 28 and drive control circuit 29 through the input/output switching circuit 25, and output side row addresses ASx "1" to "4" are outputted to the holding memory 28, hold data RD corresponding to the scanning electrode L4 is outputted to the drive control circuit 29 from the holding memory 28.

The drive control circuit 29 outputs the "dark rewriting" signal to the signal side driving circuit 12 of the FLCD 20 as display data DATA, when the hold data RD is "dark", and outputs the "bright rewriting" signal as display data DATA when the hold data RD is "bright".

Meanwhile, an output side line address CAx "1" is outputted from the output control circuit 24 to the display memory 26 and the discriminating memory 27 via the input/output switching circuit 25, and discrimination data SAME-which is the output signal of the discriminating memory 27 is checked. Since the value of discrimination data corresponding to the scanning electrode L1 is "1" as stated above, the output side line address CAx "1" is held as it is, and the value of discrimination data of the discriminating memory 27 corresponding to the scanning electrode L1 is returned to "0".

When the hold data RD corresponding to the scanning electrode L4 is outputted to the drive control circuit 29 from the holding memory 28, the output side line address CAx "1" and the output side row addresses SAx "1" to "4" held are given to the display memory 26 from the output control circuit 24 through the input-/output switching circuit 25, display data DD corresponding to the scanning electrode L1 is outputted to the drive control circuit 29 from the display memory 26 and display data PDx corresponding to the scanning electrode L1 is outputted to the holding memory 28 from the display memory 26.

Simultaneously, from the output control circuit 24 and through the input/output switching circuit 25, the output side line address ACx "1" is outputted to the holding memory 28 and the drive control circuit 29, the output side row addresses ASx "1" to "4" are outputted to the holding memory 28, the hold data RD corresponding to the scanning electrode L1 is outputted to the drive control circuit 29 from the holding memory 28, and instead, display data PDx corresponding to the scanning electrode L1 is stored in the holding memory 28 as the hold data.

The drive control circuit 29 outputs the "dark rewriting" signal as the display data DATA to the signal side driving circuit 12, when the display data DD is "dark" and the hold data RD is "bright", outputs the "bright rewriting" signal as display data DATA when the display data DD is "bright" and the hold data RD is "dark", and outputs the "non-rewriting" signal as display data DATA when the display data DD and the hold data RD are same.

Then, the output side line address ACx "8" is outputted to the holding memory 28 and the drive control circuit 29 from the output control circuit 24 through the input/output switching circuit 25, but thereafter the operations aforementioned are repeated.

That is, while the output side line address ACx "8" is outputted to the holding memory 28 and the drive control circuit 29, the output side line address CAx "2" is outputted to the display memory 26 and the discriminating memory 27. Thereafter, the output side line address ACx "2" is outputted to the holding memory 28 and the drive control circuit 29. Then, the output side line address ACx "12" is outputted to the holding memory 28 and the drive control circuit 29, while the output side line address CAx "3" is outputted to the display memory 26 and the discriminating memory 27. Then, the output side line address ACx "3" is outputted to the holding memory 28 and the drive control circuit 29.

It is repeated as such till the output side line address ACx "31" is outputted to the holding memory 28 and the drive control circuit 29, which the output side line address CAx "16" is outputted to the display memory 26 and the discriminating memory 27, and then the output side line address ACx "16" is outputted to the holding memory 28 and the drive control circuit 29.

Thereafter, when the output side line address ACx "2" is outputted to the holding memory 28 and the drive control circuit 29, and during which the output side line address CAx "17" is outputted to the display memory 26 and the discriminating memory 27, since the discrimination data SAME- which is the output signal of the discriminating memory 27 and corresponding to the scanning electrode L17 is "0" as stated above, the output side line address CAx must be incremented by one to "18". Then, the discrimination data SAME- which is the output signal of the discriminating memory 27 and corresponding to the scanning electrode L18 is rechecked, this operation being repeated up to four times. When the discrimination data SAME- still does not become "1", the output side line address CAx "20" is held as it is, and when the hold data RD corresponding to the scanning electrode L2 is outputted to the drive control circuit 29 from the holding memory 28, the output side line address ACx "20" is outputted to the holding memory 28 and the drive control circuit 29.

Then, this operation is repeated again, but when the output side line address CAx "32" is outputted to the display memory 26 and the discriminating memory 27, and the discrimination data SAME- which is the output signal of the discriminating memory 27 is to be checked, it is allowed to newly input display data Data to the display memory 26.

In such a manner, the display data DATA is inputted to the signal side driving circuit 12. In the signal side driving circuit 12, the display data DATA is sequentially transferred in a shift register, not shown, by the data transfer clock XCK and taken into a separate register, not shown, in synchronism with a latch pulse LP. When the value of display data DATA taken into the register is "dark rewriting", the dark rewriting voltage VSd is applied to the corresponding signal electrode, when the value of display data DATA is "bright rewriting" the bright rewriting voltage VSc is applied to the corresponding signal electrode, and when the value of display data DATA is "non-rewriting" the non-rewriting voltage VSg is applied to the corresponding signal electrode.

The scanning electrode address ADDR for indicating the scanning electrode corresponding to the display data DATA taken into the register stated above is outputted to the scanning side driving circuit 21 from the drive control circuit 29, and the selective voltage VCa is applied to the corresponding scanning electrode and the nonselective voltage VCb is applied to the other scanning electrodes.

As the display control apparatus 22 is constituted in such a manner, the interlaced scanning can be effected to rewrite all picture elements in four fields, by rewriting all of the picture elements of the FLCD 20 at the rate of one scanning electrode for every four adjoining scanning electrodes and skipping one selective period as, L4, L8, L12, L16, L20, L24, L28, L32, L3, L7, . . . , and during the rewriting operation, the selective voltage is applied to one scanning electrode in which data to be displayed by the picture elements of the ferroelectric liquid crystal panel has changed in one selective period which is skipped, and the signal voltage is applied to the signal electrode responsive to whether the picture elements on the selected scanning electrode should be changed from the bright display state to the dark display state, or from the dark display state to the bright display state, or the bright and dark display states should not be changed.

Since display data Data is allowed to be inputted newly to the display memory 26 only after discrimination data SAME- which is the output signal of the discriminating 27 is checked, the later frame display outputted from the personal computer 2 will never be displayed on the FLCD 20 before the former frame display.

In the embodiment described above, for the purpose of simplification, though the case wherein the FLCD 20 having the picture elements of 16×32 has been described, as a result of applying actually the display control apparatus of the embodiment, which transcribes at the rate of one scanning electrode for every adjoining 16 scanning electrodes of the FLCD having the picture elements of 1024×1024, by using the value of the holding memory, the display without deterioration in picture quality and little flickers is obtained.

In the embodiment described above, though the ratio between the partial rewriting operation and transcribing operation is 1:1, this ratio may be changed to 2:1 or 1:2. In fact, it is possible to read out continuously the hold data RD corresponding to the scanning electrodes L4, L5 from the holding memory 28 for the transcribing operation. Also, while the display data DD and hold data RD corresponding to the scanning electrode L4 are read out from the display memory 26 and the holding memory 28 for the partial rewriting operation, it is possible to change the value of output side line address CAx inputted to the discriminating memory 27 to "5", "6", "7", . . . , to check the corresponding discrimination data SAME- (at this time, the output side line address CAx inputted to the display memory 26 can be kept at "4" as it is).

Second Embodiment

Figure 21:
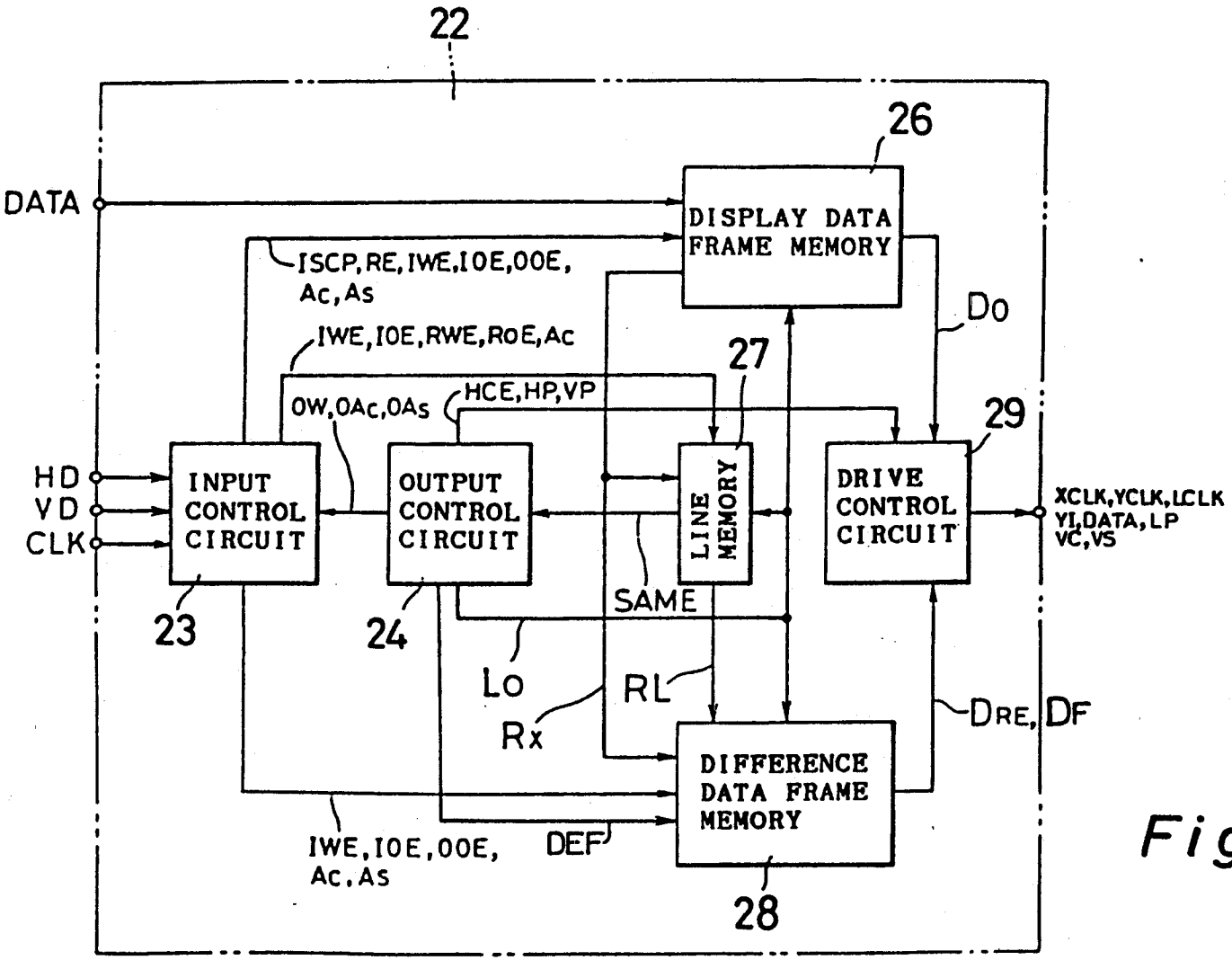
FIG. 21 is a block diagram showing a schematic configuration of the second control circuit which is the second display control apparatus.

FIG. 21 is a block diagram schematically showing a configuration of a second control circuit 22 of a second embodiment in this invention. A frame memory for display data 26 is the memory for holding display data DATA of one picture screen outputted from the personal computer 2. From the frame memory for display data 26, transformation data Rx which shows the difference between the display data displayed, at present, on the picture screen of the FLCD 20 and the display data to be displayed on the next frame is outputted.

A line memory 25 is the memory for holding separately for each scanning electrode, in response to the transformation data Rx outputted from the frame memory for display data 26, line discrimination data which shows whether or not there is even one picture element in the picture elements on the scanning electrodes of the FLCD 20, where the display data displayed at present differ from the display data to be displayed in the next frame. In the line memory 25, 1-bit memory area is allocated respectively for holding line discrimination data of each scanning electrode.

A frame memory for difference data 28 is the memory for holding the transformation data Rx of one picture screen outputted from the display data frame memory 26.

An input control circuit 23 is the circuit which controls, in response to a horizontal synchronizing signal HD, a vertical synchronizing signal VD, a clock CLK outputted from the personal computer 2, and signals OW, OAc, OAs outputted from an output control circuit 24, writing of data into the display data frame memory 26, line memory 27 and difference data frame memory 28.

The output control circuit 24 is the circuit for reading out hold data from the display data frame memory 26, line memory 27 and difference data frame memory 28, and controlling output of a drive control circuit 29.

The drive control circuit 29 is the circuit for outputting the control signal of display drive of the FLCD 20, in response to data Do given from the display data frame memory 26 and data DRE, DF given from the difference data frame memory 28.

FIG. 3 is a plan view showing a configuration in which a scanning side driving circuit 11 is connected to the scanning electrode L of the FLCD 20 having a simple matrix configuration described above and a signal side drive circuit 12 is connected to the signal electrode S thereof. The scanning side driving circuit 11 is the circuit for applying the voltage to the scanning electrode L, and the signal side driving circuit 12 is the circuit for applying the voltage to the signal electrode S. Here, as same as the case of conventional example, for the purpose of simplification, the case of 32 scanning electrodes L and 16 signal electrodes S, that is the case of FLCD 20 constituted by 32×16 picture elements is shown. Respective scanning electrodes L are distinguished by adding an index i (i=1 to 32) to a symbol L, and respective signal electrodes S are distinguished by adding an index j (j=1 to 16) to a symbol S. In the following description, as same as the case of describing the conventional example, the picture element in the intersecting area of any scanning electrode Li and any signal electrode Si is represented by an index Aij.

Figure 22:
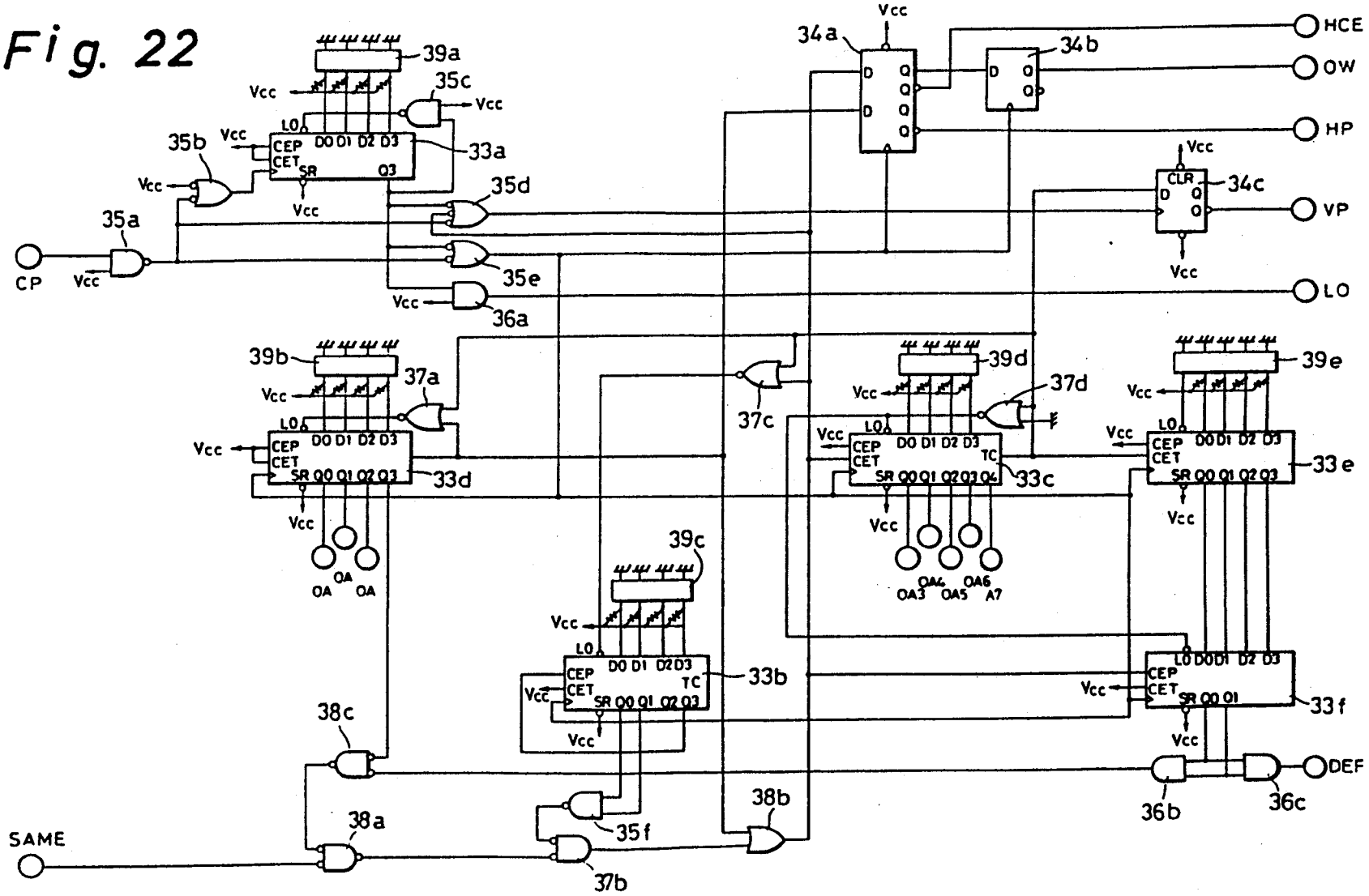
FIG. 22 is a circuit diagram showing an example of specific configuration of an output control circuit in the second control circuit.

A specific configuration of a control circuit 22 used in the FLCD 20 is shown in FIG. 22 to FIG. 27. FIG. 22 shows a configuration of the output control circuit 24, which is constituted by six counters 33*a* to 33*f*, three latch circuits 34*a* to 34*c*, six NAND gates 35*a* to 35*f*, three AND gates 36*a* to 36*c*, four NOR gates 37*a* to 37*d*, three OR gates 38*a* to 38*c* and five DIP switches 39*a* to 39*e*.

Figure 23:
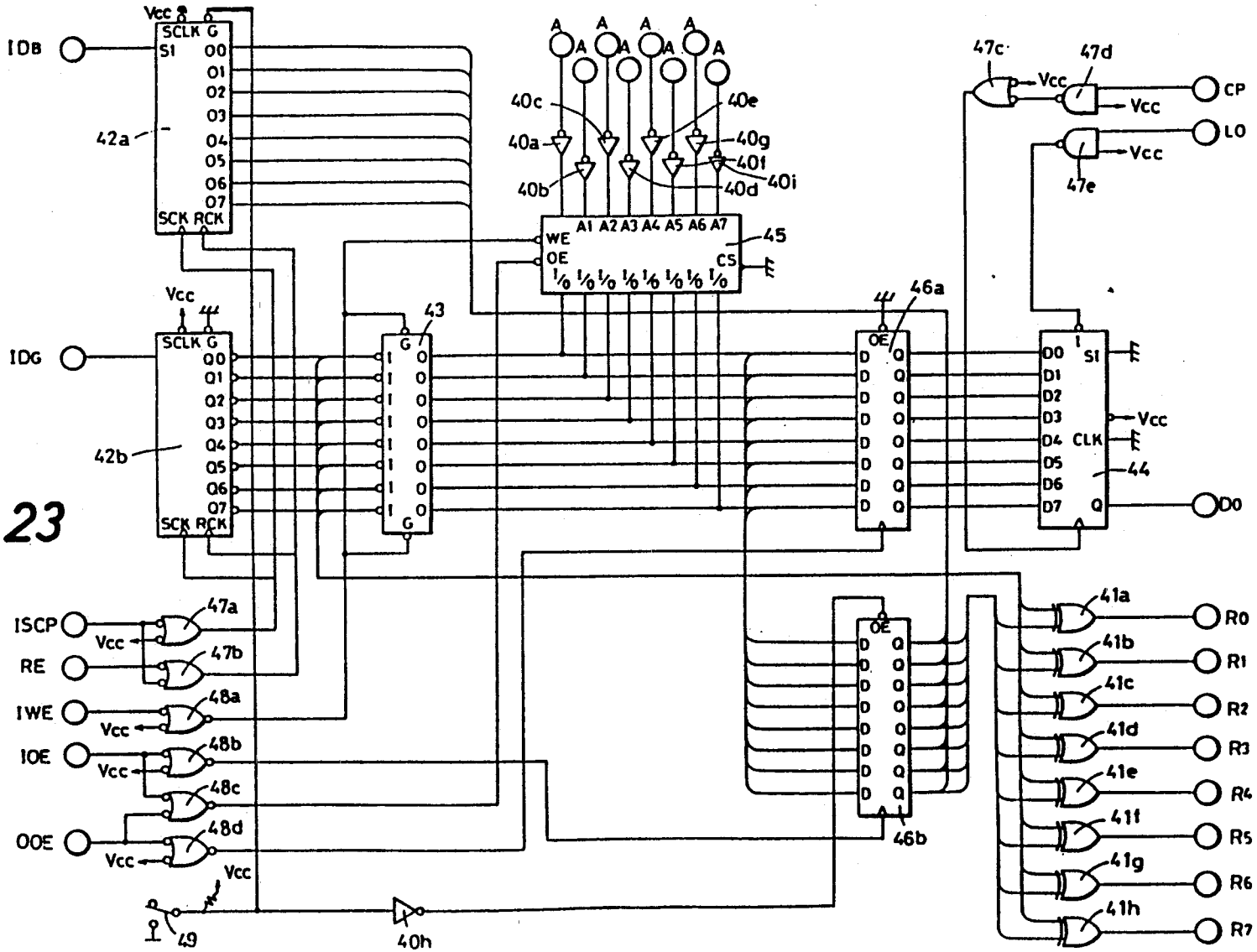
FIG. 23 is a circuit diagram showing an example of specific configuration of a display data frame memory in the second control circuit.

FIG. 23 shows a configuration of the display data frame memory 26, which is constituted by nine NOT gates 40*a* to 40*i*, eight EXCLUSIVE-OR gates 41*a* to 41*h*, two shift registers with latch function 42*a*, 42*b*, one 3-state output buffer 43, one shift register 44, one static RAM (random access memory) 45, two latch circuits 46a, 46b, five NAND gates 47a to 47e, four AND gates 48a to 48d and a switch.

Figure 24:
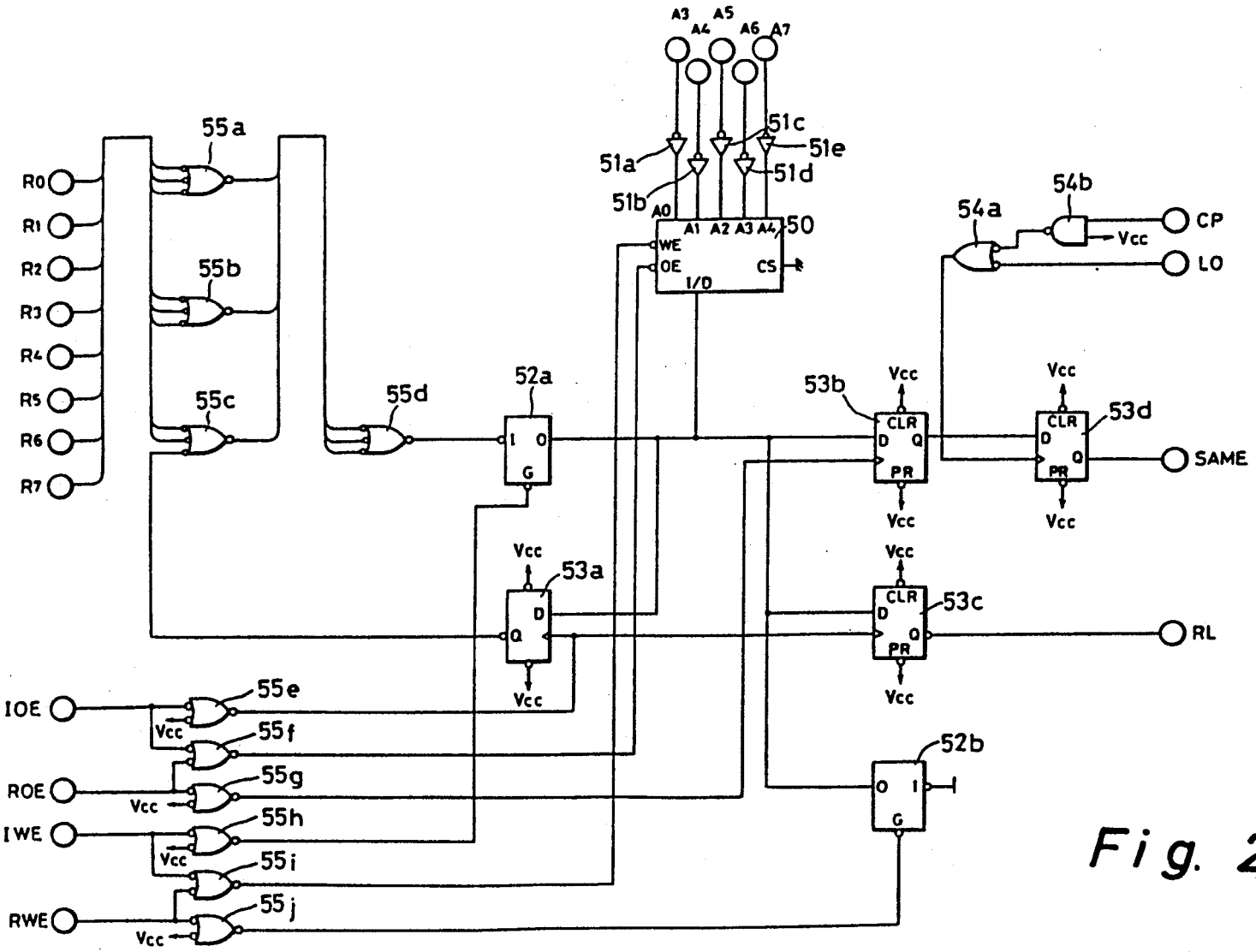
FIG. 24 is a circuit diagram showing an example of specific configuration of a line memory in the second control circuit.

FIG. 24 shows a configuration of the line memory 27, which is constituted by one static RAM 50, five NOT gates 51 a to 51e, two 3-state output buffers 52a, 52b, four latch circuits 53a to 53d, two NAND gates 54a, 54b and ten AND gates 55a to 55j.

Figure 25:
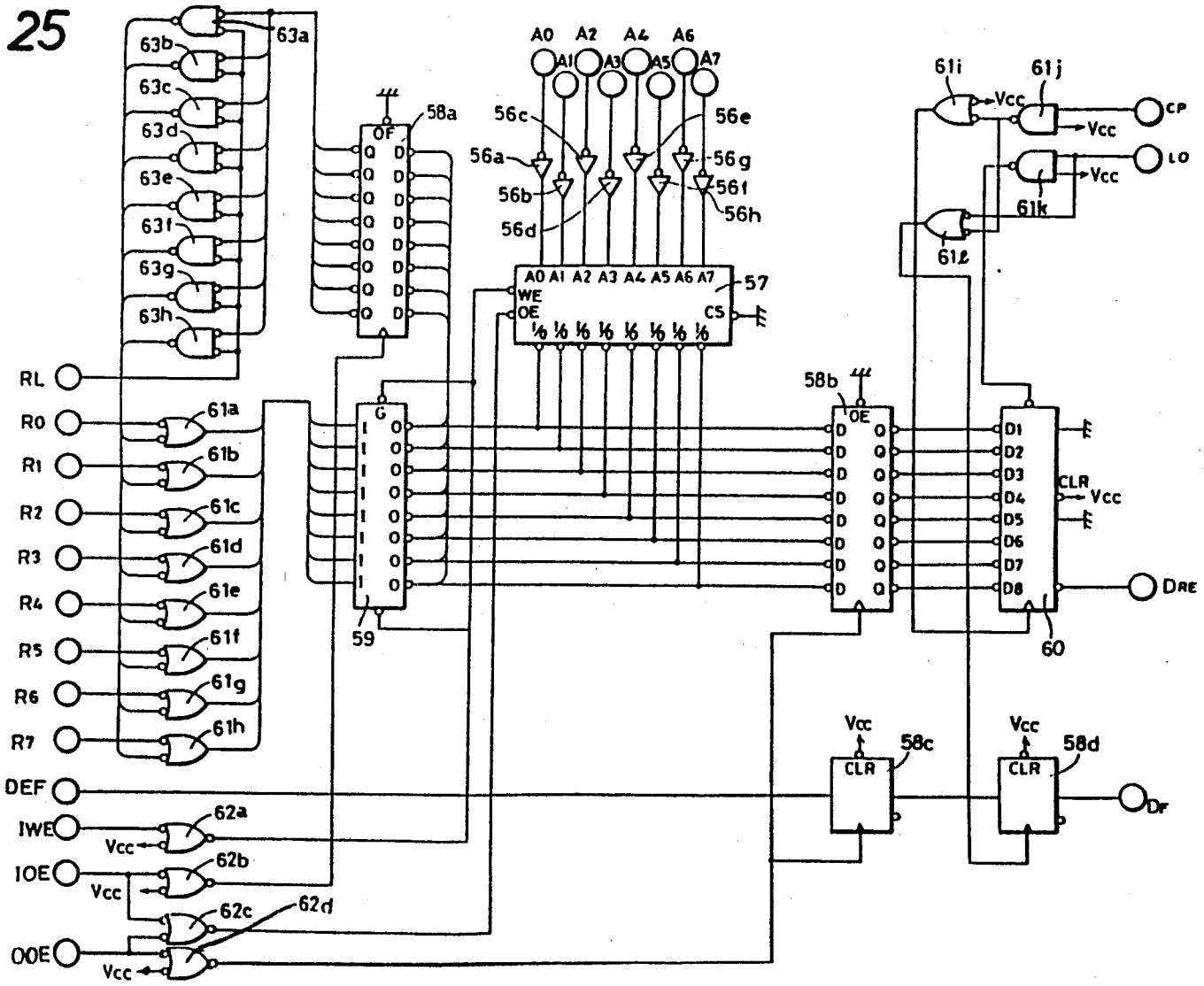
FIG. 25 is a circuit diagram showing an example of specific configuration of a difference data frame memory in the second control circuit.

FIG. 25 shows a configuration of the difference data frame memory 28, which is constituted by eight NOT gates 56a to 56h, one static RAM 57, four latch circuit 58a to 58d, one 3-state output buffer 59, one shift register 60, twelve NAND gates 61a to 61l, four AND gates 62a to 62d and eight OR gates 63a to 63h.

Figure 26:
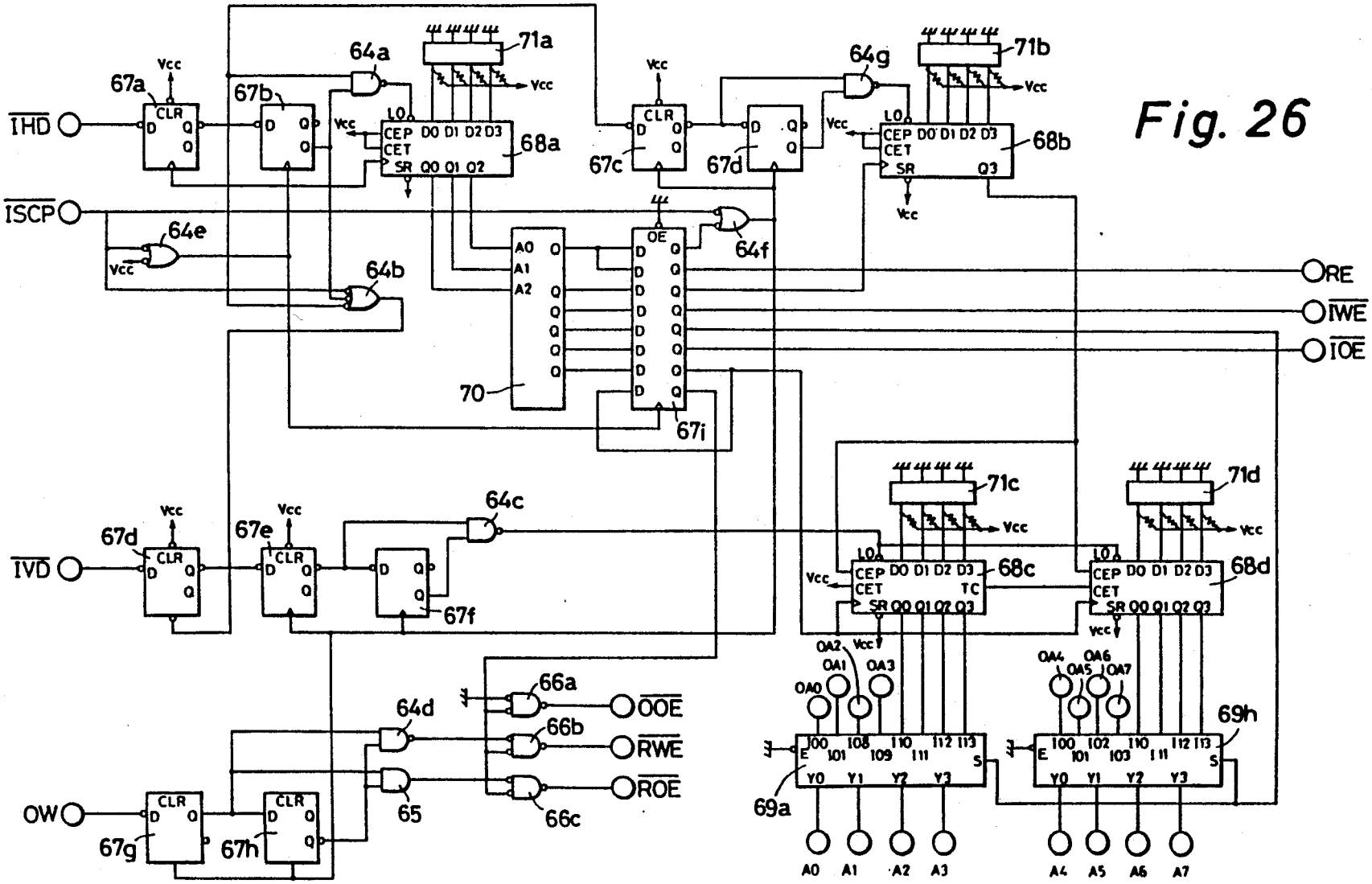
FIG. 26 is a circuit diagram showing an example of specific configuration of an input control circuit in the second control circuit.

FIG. 26 shows a configuration of the input control circuit 23, which is constituted by seven NAND gates 64a to 64g, one AND gate 65, three OR gates 66a to 66c, eight latch circuits 67a to 67i, four counters 68a to 68d, two selectors 69a, 69b, one programmable ROM (read only memory) 70 and four DIP switches 71a to 71d.

Figure 27:
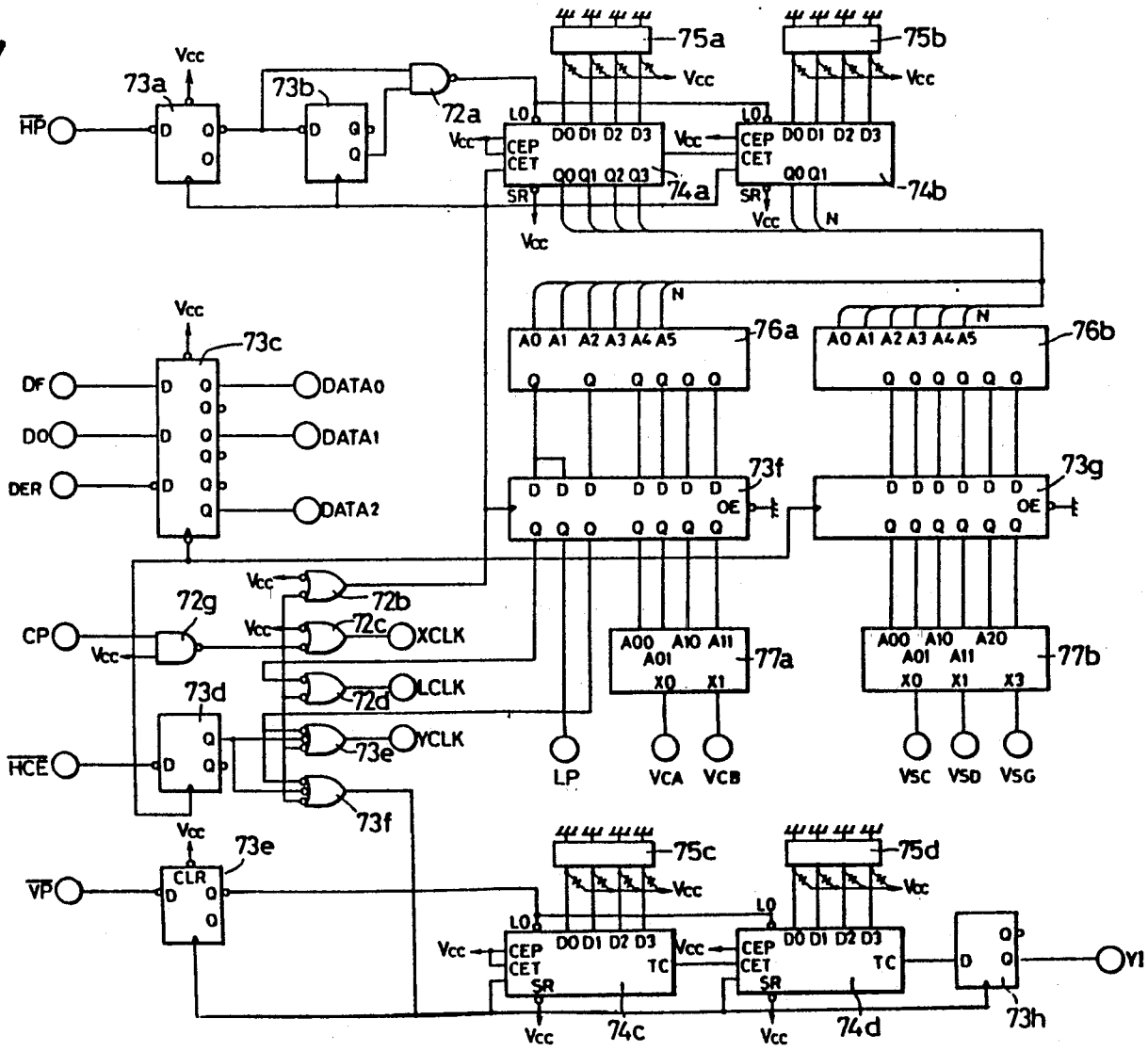
FIG. 27 is a circuit diagram showing an example of specific configuration of a drive control circuit in the second control circuit.

FIG. 27 shows a configuration of the drive control circuit 29 which is constituted by seven NAND gates 72a to 72g, eight latch circuits 73a to 73h, four counters 74a to 74d, four DIP switches 75a to 75d, two programmable ROMs 76a, 76b and 2 sets of digital/analog converters 77a, 77b.

The operation for switching the picture screen of the FLCD 20 from the state wherein Japanese characters meaning "FERROELECTRIC" are displayed to the state wherein Japanese characters meaning "ORDINARY DIELECTRIC" are displayed described in the conventional example, by using the control circuit 22 for the FLCD 20, will be described with reference to FIG. 3, FIG. 11, FIG. 28 and FIG. 33. Where, one selective time (6to) in this case is about 600 microseconds.

Figure 4:
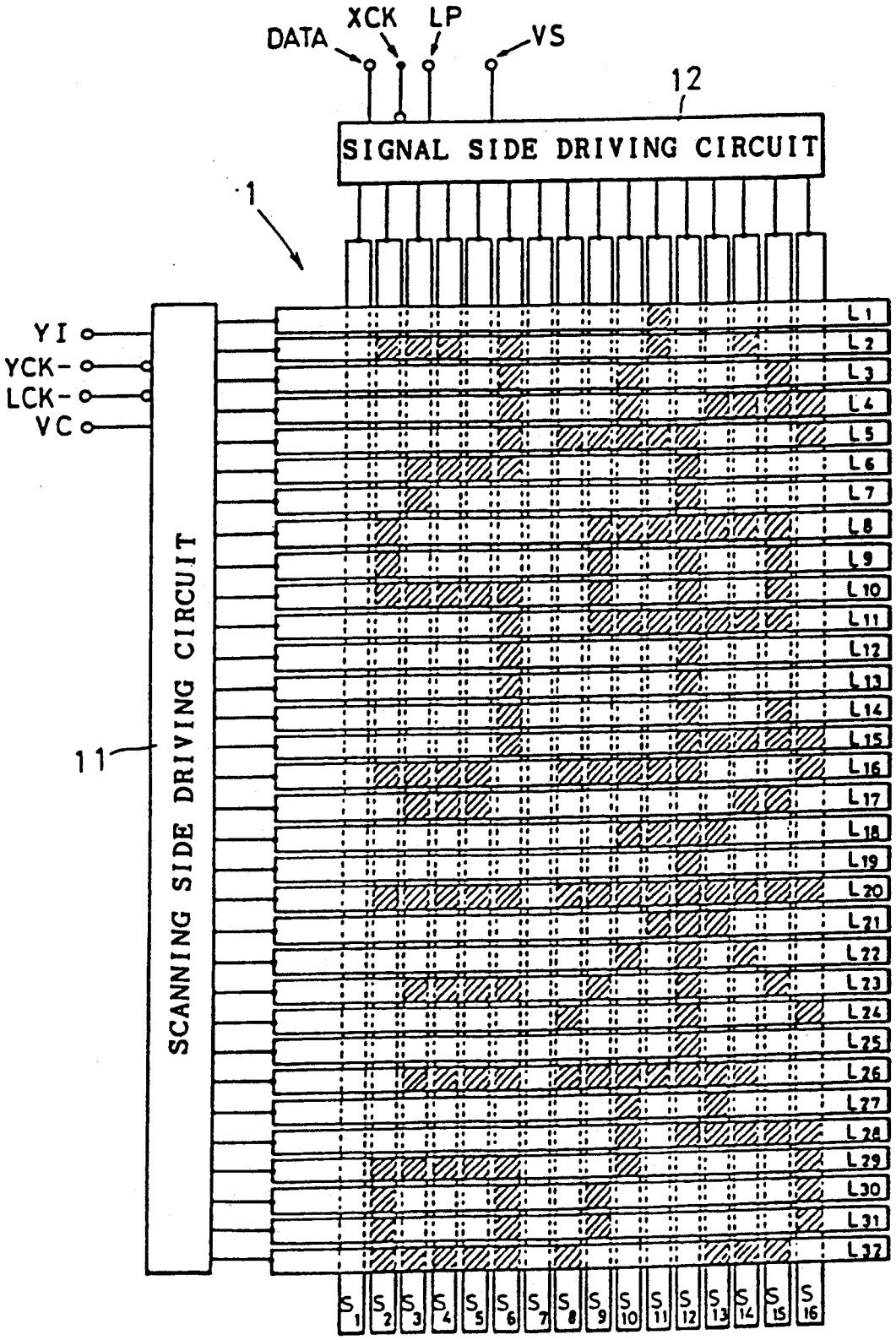
FIG. 4 is a view showing a display state of Japanese characters meaning "FERROELECTRIC" on a ferroelectric liquid crystal display.

When Japanese characters meaning "FERROELECTRIC" are displayed on the picture screen of the FLCD 20, and while display data DATA displaying the characters "FERROELECTRIC" is continuously outputted to the control circuit 22 from the personal computer 2, display data DO held in the display data frame memory 26 is in the state of FIG. 4 described in the conventional example.

When the display data DATA outputted from the personal computer 2 has changed, in this state, from "FERROELECTRIC" to "ORDINARY DIELECTRIC", from the display data frame memory 26, transformation data Rx of one picture screen which is the difference between "FERROELECTRIC" and "ORDINARY DIELECTRIC" and is shown schematically in FIG. 11 is outputted to the line memory 27 and the difference data frame memory 28. Though the transformation data Rx is held as it is in the difference data frame memory 28, in the line memory 27, it is held in the lump for one scanning electrode. That is, referring to FIG. 11, when there is even one picture element among the picture elements on this one scanning electrode which is displayed by the "dark" display, on whose display data differ between the preceding and succeeding frames, "1" is held as line discrimination data SAME, and when there is no picture element which is displayed by the "dark" display, "0" is held.

The operation aforementioned is controlled by the input control circuit 23. That is, the input control circuit 23 is initialized by a synchronizing signal IHD obtained by holding a horizontal synchronizing signal HD outputted from the personal computer 2 once in a latch circuit, and a synchronizing signal IVD obtained by holding a vertical synchronizing signal VD once in the latch circuit, and is operated in synchronism with a clock ISCP which is obtained by delaying, a data transfer clock CLK outputted similarly from the personal computer 2, in a gate (these latch circuit and gate are not shown), and data IDG which is a part of display data DATA outputted from the personal computer 2, a timing pulse RE for conducting parallel conversion in the display data frame memory 26, a timing pulse IOE for reading out data from the memories 26, 27 and 28, a timing pulse IWE for writing data into the memories 26, 27 and 28, a line address AC, which is obtained by switching an output side line address OAc sent from the output control circuit 24 and an input side line address IAc sent from the input control circuit 23, showing a line position of data to be read and written of the memories 26, 27 and 28, and an address As, which is obtained by switching an output side row address OAs outputted from the output control circuit 24 and an input side row address IAs outputted from the input control circuit 23, showing a row position of data to be read and written of the memories 26 and 28 are outputted to respective memories to control the aforesaid operation.

In parallel with the operation abovementioned, data DO held in the display data frame memory 26 and data DRE held in the difference data frame memory 28 are outputted to the drive control circuit 29. A data transfer time T1 necessary for outputting the data DO and DRE is set sufficiently shorter than one selective time (6t0). Before entering the data transfer time T1, line discrimination data SAME of the line memory 27 corresponding to the scanning electrode L is confirmed by the output control circuit 24, and when the state, wherein the line discrimination data SAME is "0", is to continue, the operation of confirming the line discrimination data SAME corresponding to the next scanning electrode L is repeated, and when the line discrimination data SAME corresponding to the scanning electrode decided in advance for each frame is to be confirmed next, regardless of whether the line discrimination data SAME is "0" or "1", data DO and DRE corresponding to the scanning electrode are sent to the drive control circuit 29 from the frame memories 26, 28, and at the same time, state data DF=1 is outputted to the drive control circuit 29 from the difference data frame memory 28, by instructions from the output control circuit 24. When the line discrimination data SAME becomes "1" before the decided scanning electrode is to be confirmed next, data DO, DRE corresponding to the scanning electrode are outputted to the drive control circuit 29 from the frame memories 26, 28, and at the same time, state data DF=0 is outputted to the drive control circuit 29 from the difference data frame memory 28, by instruction from the output control circuit 24. In the line memory 27, after the line discrimination data SAME has been outputted, the content of the line discrimination data SAME corresponding to the scanning electrode L is set to "0". When line discrimination data corresponding to the last scanning electrode L32 of one picture screen has been confirmed in such a way, at this time point, the scanning electrode to be selected in the next frame is decided. It is so set that the scanning electrode which is decided to be selected in advance, extends to all scanning electrodes of one picture screen extending over plural frames.

The aforesaid operation is controlled by the output control circuit 24. That is, the output control circuit 24 is operated in synchronism with a clock CP outputted from an internal clock generating circuit which is not shown in FIG. 21, by outputting the timing pulse OW, output side line address OAc and output side row address OAs from the input control circuit 23, timing pulses ROE, RWE for reading and resetting line discrimination data SAME of the line memory 27, and a line address Ac indicating a line position of data to be read are outputted from the input control circuit 23, a timing pulse OOE for reading data DO, DEF of the frame memories 26, 28, a line address Ac indicating a line position of data to be read and a row address As indicating a row address there of are outputted from the input control circuit 23, data DO, DRE transformed parallelly and held in the frame memories 26, 28 are transformed serially by outputting the timing pulse LO to the frame memories 26, 28 and by outputting timing data DEF to the difference data frame memory 28, state data DF, which informs whether the data DO, DRE outputted, at present, from the difference data frame memory 28 are that data corresponding to the scanning electrode decided in advance for each frame, is outputted to the drive control circuit 29.

There after, in case the display data DATA of "ORDINARY DIELECTRIC" is continuously outputted to the display data frame memory 26 from the personal computer 2, the data DO held in the display data frame memory 26 becomes as shown in FIG. 3 described in the conventional example, but transformation data Rx outputted from the display data frame memory 26 are all "0" which corresponds to the picture elements shown without oblique lines in FIG. 11. Though the transformation data Rx is outputted to the line memory 27 and the difference data frame memory 28, in the line memory 27, when the line discrimination data SAME having the same row address Ac is not reset to "0" (namely, data DO, DRE of the corresponding scanning electrode are not read), the line discrimination data SAME can not be rewritten from "1" to "0", and also in the difference data frame memory 28, when the line discrimination data SAME having the same row address Ac is not "0", the difference data DRE can not be rewritten from "1" to "0".

The output control circuit 24 outputs a timing pulse HP which decides one selective time and timing pulses VP, HCE which indicate a line position of the data DO, DRE outputted at present to the drive control circuit 29.

The drive control circuit 29 is initialized by the timing pulse HP, in synchronism with the clock CP, the clock LCLK, a selective voltage VCA and a non-selective voltage VCB are produced and outputted to the scanning side driving circuit 11, and the clock XCLK, latch pulse LP, bright rewriting voltage VSC, dark rewriting voltage VSD and non-rewriting voltage VSG are produced and outputted to the signal side driving circuit 12. A selective signal YI which is initialized by the timing pulse VP and is in synchronism with the timing pulse HCE and clock CP, and a clock YCLK which is initialized by the timing pulse HCE and is in synchronism with the clock CP are outputted to the scanning side driving circuit 11. Data DO, DRF and DF are processed by a circuit, not shown, and outputted to the signal side driving circuit 12 as data DATA.

Figure 28:
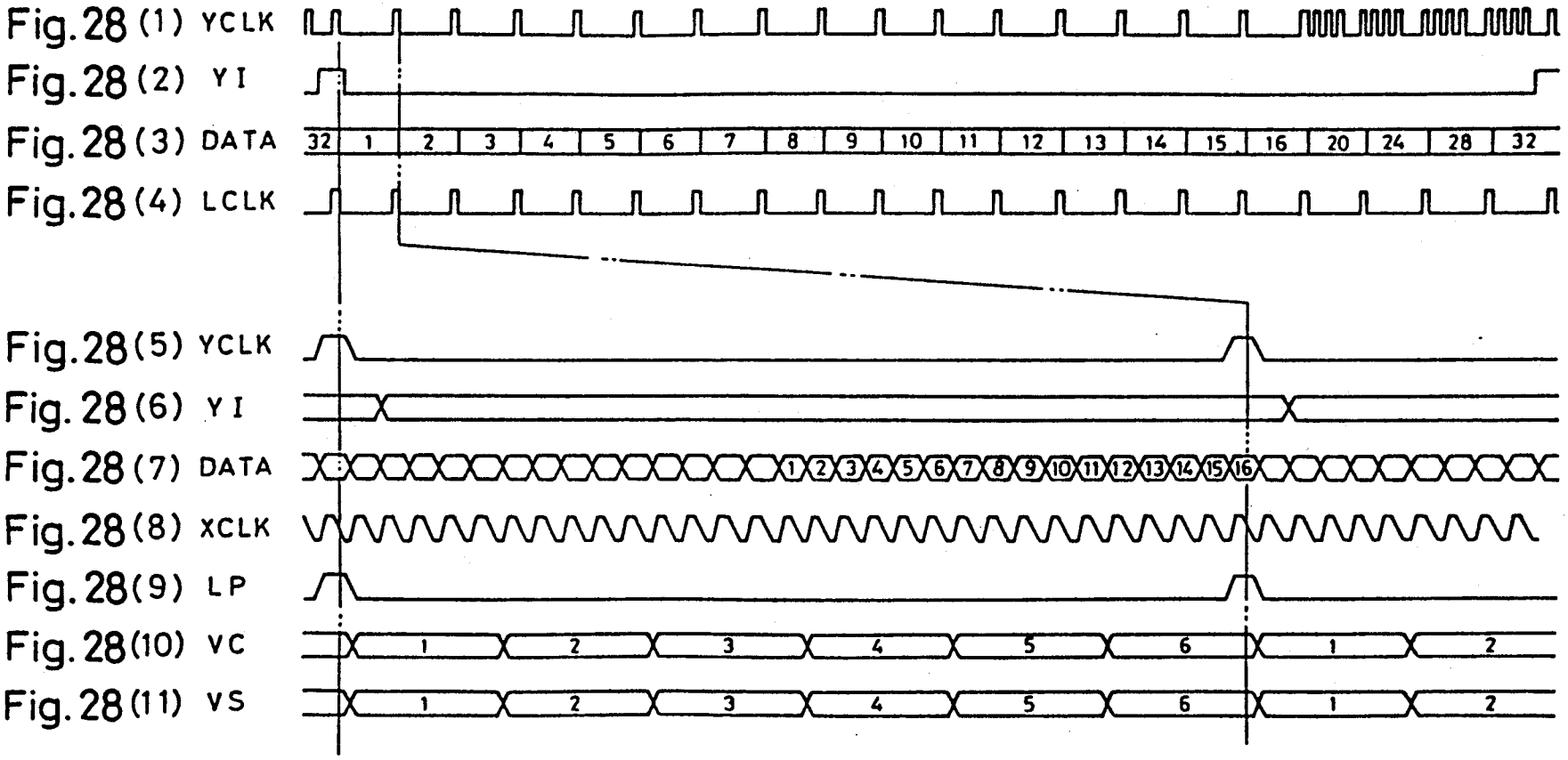
FIG. 28 and FIG. 29 are waveform diagrams respectively showing output signals of the second control circuit.
Figure 29:
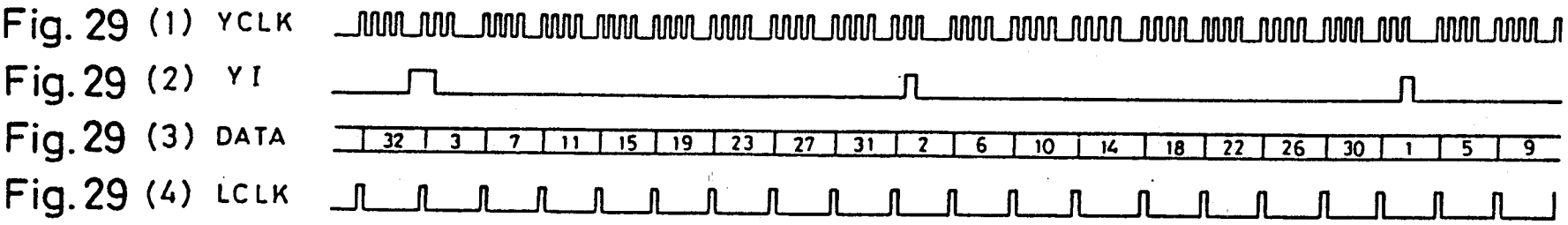

As a result of the operation stated above, signals shown in FIG. 28 and FIG. 29 are outputted from the control circuit 22 to the FLCD 20. In the figures, FIG. 28(2) and FIG. 29(2) are waveform diagrams showing the selective signal YI for selecting the scanning electrode L, FIG. 28(1) and FIG. 29(1) are waveform diagrams showing the clock YCLK for sequentially transferring the selective signal YI in a shift resister, not shown, included in the scanning side driving circuit 11, FIG. 28(3) and FIG. 29(3) show display data DATA corresponding to the picture elements of the FLCD 20, and FIG. 28(4) and FIG. 29(4) are waveform diagrams showing a clock LCLK which takes the selective signal YI in the shift register of the scanning side driving circuit 11 into a latch circuit, not shown, included in the same scanning side driving circuit 11, and gives a timing for holding one selective time of the scanning electrode L.

FIG. 28(5) is a waveform diagram showing the clock YCLK expanded into one selective time, FIG. 28(6) is a waveform diagram showing the selective signal YI expanded into one selective time, FIG. 28(7) is a waveform diagram showing the display data DATA expanded into one selective time, FIG. 28(8) is a waveform diagram showing a data transfer clock XCLK for sequentially transferring the display data DATA in the shift register, not shown, included in the signal side driving circuit 12, FIG. 28(9) is an expanded view of the latch pulse LP which gives timing to take in and hold the display data DATA in the shift register of the signal side driving circuit 12 in a separate register, not shown, included in the same signal side driving circuit 12, FIG. 28(10) is a voltage waveform VC in which the selective voltage VCA and the non-selective voltage VCB applied to the scanning electrode L are omitted, and FIG. 28(11) is a voltage waveform VS in which the bright rewriting voltage VSC, dark rewriting voltage VSD and non-rewriting voltage VSG applied to the signal electrode S are omitted. FIG. 29(1) to FIG. 29(4) shown waveforms following the waveforms shown in FIG. 28(1) to FIG. 28(4).

The operation of the display control apparatus will be explained along FIG. 28 and FIG. 29. Assuming that the scanning electrodes L1, L5 to L29 in the frame displayed at present are the scanning electrodes which are decided to be selected in advance, and that, while the scanning electrodes L17 to L29 are selected, display data DO held in the display data frame memory 26 changes from the character display of "FERROELECTRIC" of FIG. 4 to the character display of "ORDINARY DIELECTRIC" of FIG. 3, difference data DRE of the difference data frame memory 28 becomes as shown schematically in FIG. 11, and line discrimination data SAME of the line memory 27 becomes "1" from the scanning electrodes L1 to L16, and becomes "0" from the scanning electrodes L17 to L32.

At the end of the frame, it is decided that the scanning electrodes L4, L8 to L32 are selected in advance in the next frame.

In the next frame, the output side line address OAc=1 and the timing pulse OW are outputted to the input control circuit 23 from the output control circuit 24, and from the input control circuit 23, the line address Ac=1 and the timing pulse RWE following the timing pulse ROE are outputted to the line memory 27. From the line memory 27, line discrimination data SAME=1 corresponding to the line address Ac=1 is outputted to the output control circuit 24, and the discrimination data SAME corresponding to the line address Ac=1 is reset to "0" immediately. Upon this, the output control circuit 24 starts to select the scanning electrode L1, outputting the state data DF=0 from the difference data frame memory 28, and the data DO, DRE corresponding to the scanning electrode L1 from the frame memories 26, 28.

Though the aforesaid operation is repeated on the scanning electrodes L2, L3, as the scanning electrode L4 is decided to be selected in advance, the line discrimination data SAME corresponding to the line address Ac=4 of the line memory 27 is reset "0", outputting state data DF=1 from the difference data frame memory 28, and the data DO, DRE corresponding to the scanning electrode L4 are outputted from the frame memories 26, 28.

The operation is repeated from the scanning electrodes L5 to L16. Next, when the output side line address OAc=17 is outputted from the output control circuit 24, from the line memory 26 line discrimination data SAME=0 corresponding to the line address Ac=17 is outputted to the output control circuit 24, and the output side line address OAc outputted from the output control circuit 24 is incremented by 1 to "18". Then, though the line discrimination data SAME is continuously "0", when the output side line address OAc becomes "20", as the scanning electrode L20 is the one which is decided to be selected in advance, the operation same as the case of the scanning electrode L4 is started. The similar operation is repeated there after, and when the last scanning electrode L32 is selected, it is decided to select the scanning electrodes L3, L7 to L31 in the next frame in advance.

After four frames onward, all of the scanning electrodes are selected in such a manner.

Now, in the FLCD 20, in case the voltage values of the scanning voltage waveforms VCA, VCB and the signal voltage waveforms VSC, VSD, VSG are fixed, since the writing characteristic is changed by panel temperature, one selective time should be changed to compensate the characteristic. Since one selective time is fixed at fixed times of the clock CP period in the system aforementioned, it is possible to compensate the characteristic by changing the clock CP frequency. An internal clock generating circuit, which is not shown in FIG. 21, optimizes the clock CP frequency.

Figure 30:
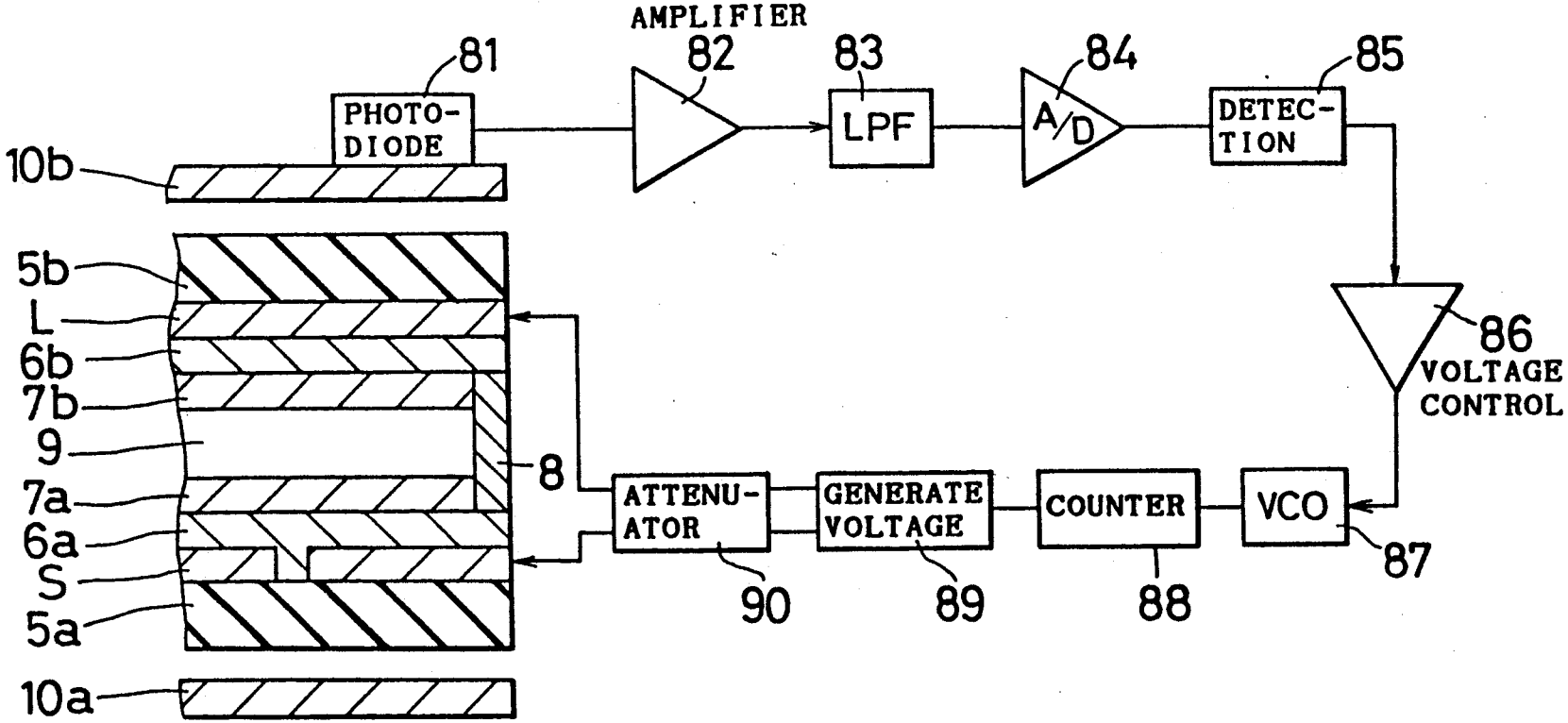
FIG. 30 is a block diagram showing a schematic configuration of an internal clock generating circuit for the control circuit.

The specific internal clock generating circuit includes, as shown in FIG. 30, a photodiode 81, an amplifier 82, a low pass filter 83, an analog/digital converter 84, a detecting circuit 85, a voltage control circuit 86, a voltage control oscillator 87, a counter 88, a voltage generator 88 and an attenuator 90.

Frequencies of the clock CP generated from the voltage control oscillator 87 are changed by the voltage outputted from the voltage control circuit 86, time 2× to which is fixed times of the clock CP period is prepared in the counter circuit 88 to obtain a field period T2 which is plural times of the time 2× to, in even-numbered fields the voltage 0 is outputted after outputting the voltage-Vth for the time to after outputting the voltage Vth for the time t0, and in odd-numbered fields the voltage 0 is outputted after outputting the voltage Vth for the time to after outputting the voltage-Vth for the time t0. The voltage waveform is attenuated in the attenuator 90 and applied to a panel. The attenuating ratio of the attenuator 90 is decided by watching whether the panel is actually rewritten entirely.

In such a way, the picture elements of the panel are partially brought to the "bright" and "dark" states, and the transmission light quantity of the panel then is detected by a light/voltage converter 81 to transform into the analog voltage, which is amplified in the amplifier 82, and inputted to the analog/digital converter 84 through the low-pass filter 83 for taking out the frequency close to the field period (as this field frequency is sufficiently long, there is hardly any light having the lower frequency than this).

In the analog/digital converter 84, based on the mean value of input voltage extending over several fields, the input voltage is transformed into the digital signal in response to whether the input voltage is higher or lower than the voltage. The signal is inputted to the detecting circuit 85, in which the input signal is sampled once per one field, and when values in the preceding and succeeding fields are different, the output voltage of the voltage control circuit 86 is slightly raised, the output clock CP frequency of the voltage control oscillator 87 is increased and the applying time voltage Vth is shortened, when values in the preceding and succeeding fields are equal, the output voltage of the voltage control circuit 86 is slightly lowered, the output clock CP frequency of the voltage control oscillator 87 is reduced and the applying time of voltage Vth is lengthened.

Voltages applied to the panel at this time are shown in FIG. 31(1) and FIG. 31(3), and estimated transmission light quantities corresponding to FIG. 31(1) and FIG. 31(3) are shown in FIG. 31(2) and FIG. 31(4). In FIG. 31(1), though the applying time of the voltage Vth to the panel exceeds a threshold value of the panel, and the transmission light quantity of the panel changes sufficiently as shown in FIG. 31(3), in which the applying time of the voltage Vth to the panel is below the threshold value of the panel, and the transmission light quantity of the panel does not change sufficiently as shown in FIG. 31(4). Though the impressed time of the voltage Vth from the attenuator 90 moves between FIG. 31(1) and FIG. 31(3), since this voltage Vth is set lower than the rewriting voltage (3VD in FIG. 12) applied from the scanning side driving circuit 11 and the signal side driving circuit 12 by the attenuator 90, the rewriting voltage is adequately higher than the threshold value of the panel.

When the display control apparatus is constructed by using the control circuit 22 shown in FIG. 21, in case the selective voltage is applied to the scanning electrode, it is possible to distinguish whether the selective voltage is applied because the scanning electrode is the one decided in advance for each frame, or though it is not the scanning electrode decided in advance the selective voltage is applied to the scanning electrode because the display state of the picture elements there on must be changed, thus it can be decided to select the whole scanning electrodes extending over the several frames in advance.

Next, as described by using the control circuit 22 of FIG. 21, the difference in operation of the drive control circuit 29 and the difference in voltages applied to the picture elements, due to difference in line discrimination data, between the case therein the selective voltage is applied to the corresponding scanning electrode, and the case wherein the selective voltage is applied to the electrode which is decided in advance for every frame regardless of the content of the line discrimination data, will be described.

In the control circuit 22 shown in FIG. 21, when data DF outputted from the difference data frame memory 28 to the drive control circuit 29 is "1" (scanning electrode which is decided to be selected in advance for every frame), regardless of data DRE outputted to the drive control circuit 29 from the difference data frame memory 28, depending upon to which display states "bright" or "dark" the data DO outputted from the display data frame memory 26 to the drive control circuit 29 responds, the voltage waveform outputted to the signal electrode S from the signal side driving circuit 12 will be the bright rewriting voltage waveform or the dark rewriting voltage waveform.

In case data DRE is "1" when data DF is "0" (scanning electrode whose picture element display state must be changed), depending upon to which display states "bright" or "dark" the data DO responds, the voltage waveform out putted to the signal electrode S from the signal side driving circuit 12 will be the bright rewriting voltage waveform or the dark rewriting voltage waveform, and in case data DRE is "0", regardless of the data DO, the voltage waveform outputted to the signal electrode S from the signal side driving circuit 12 will be the non-rewriting voltage waveform.

Figure 12:
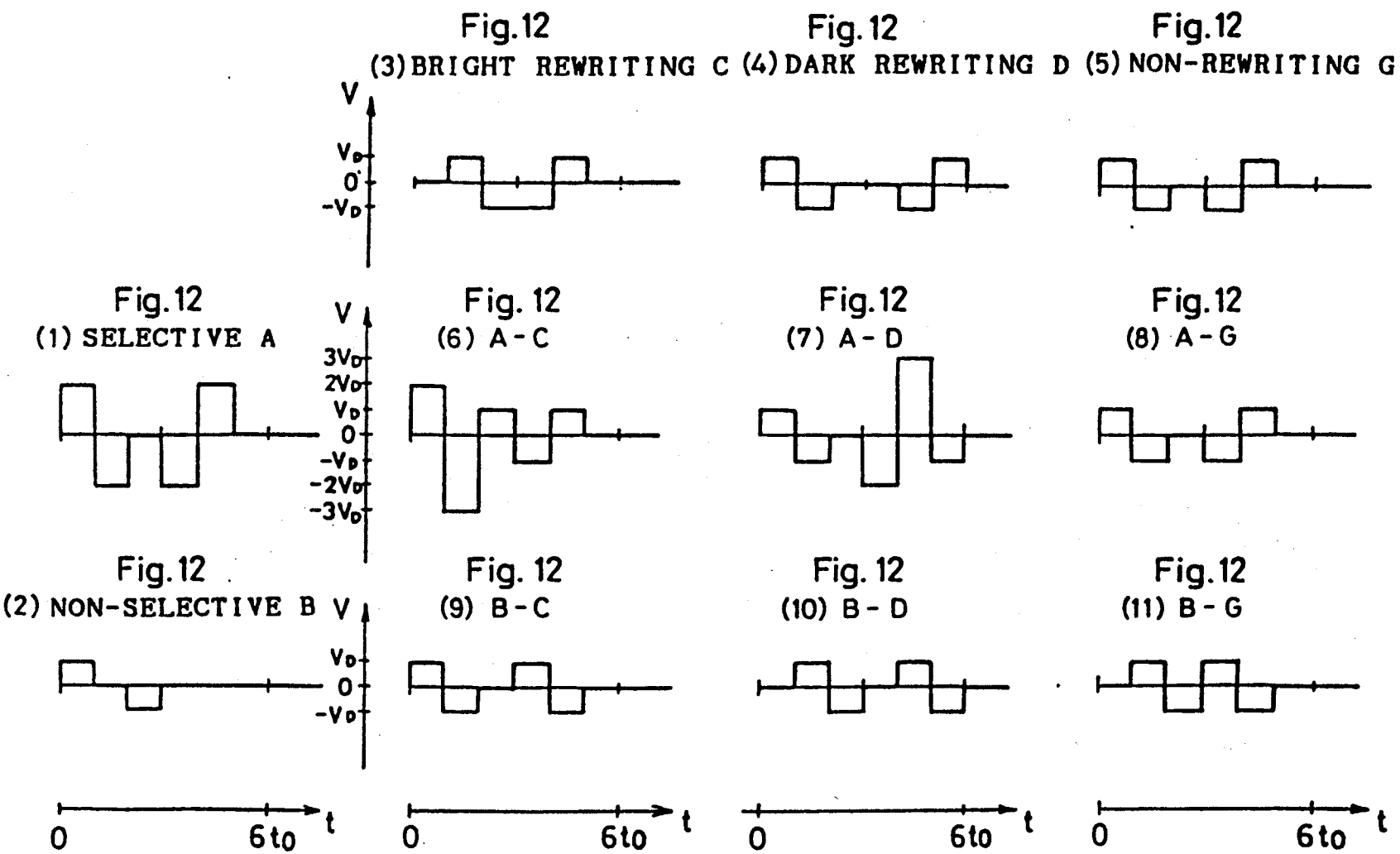
FIG. 12 is a waveform diagram showing respective impressed voltages used for driving a ferroelectric liquid crystal panel in a display control apparatus, wherein FIG. 12(1) illustrates the waveform of selective voltage A applied to scanning electrodes, FIG. 12(2) illustrates the waveform of non-selective voltage B applied to scanning electrodes, FIG. 12(3) illustrates the waveform of a bright rewriting voltage C applied to signal electrodes, FIG. 12(4) illustrates the waveform of a dark rewriting voltage D applied to signal electrodes, FIG. 12(5) illustrates the waveform of a non-rewriting voltage G applied to signal electrodes, and FIGS. 12(6) to 12(11) illustrate waveform diagrams of an effective voltage applied to picture element $A_{ij}$.
Figure 13:
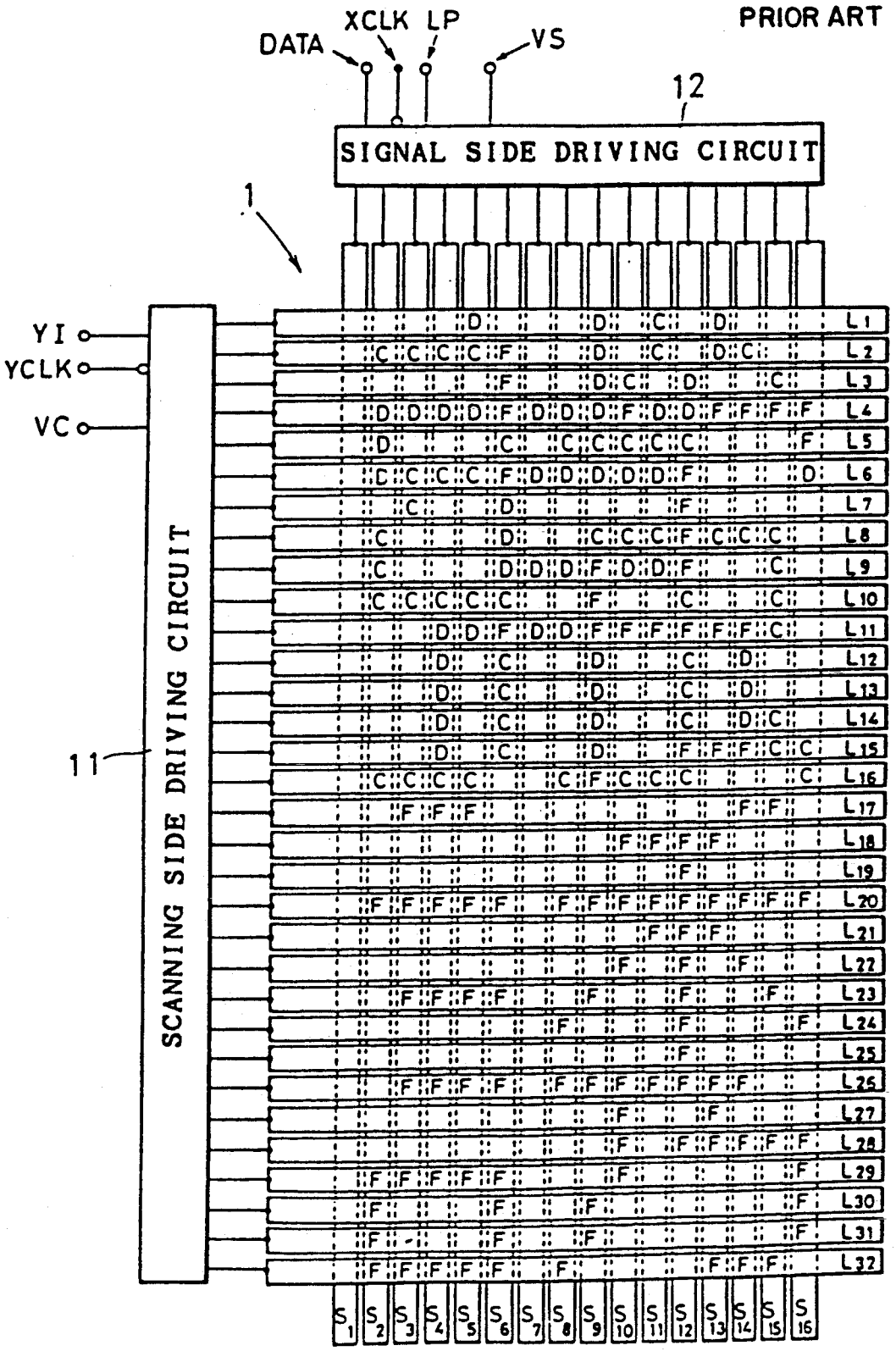
Fig. 13 PRIOR ART
FIG. 13 is a view showing changes in the display state of the ferroelectric liquid crystal panel.
Figure 14:
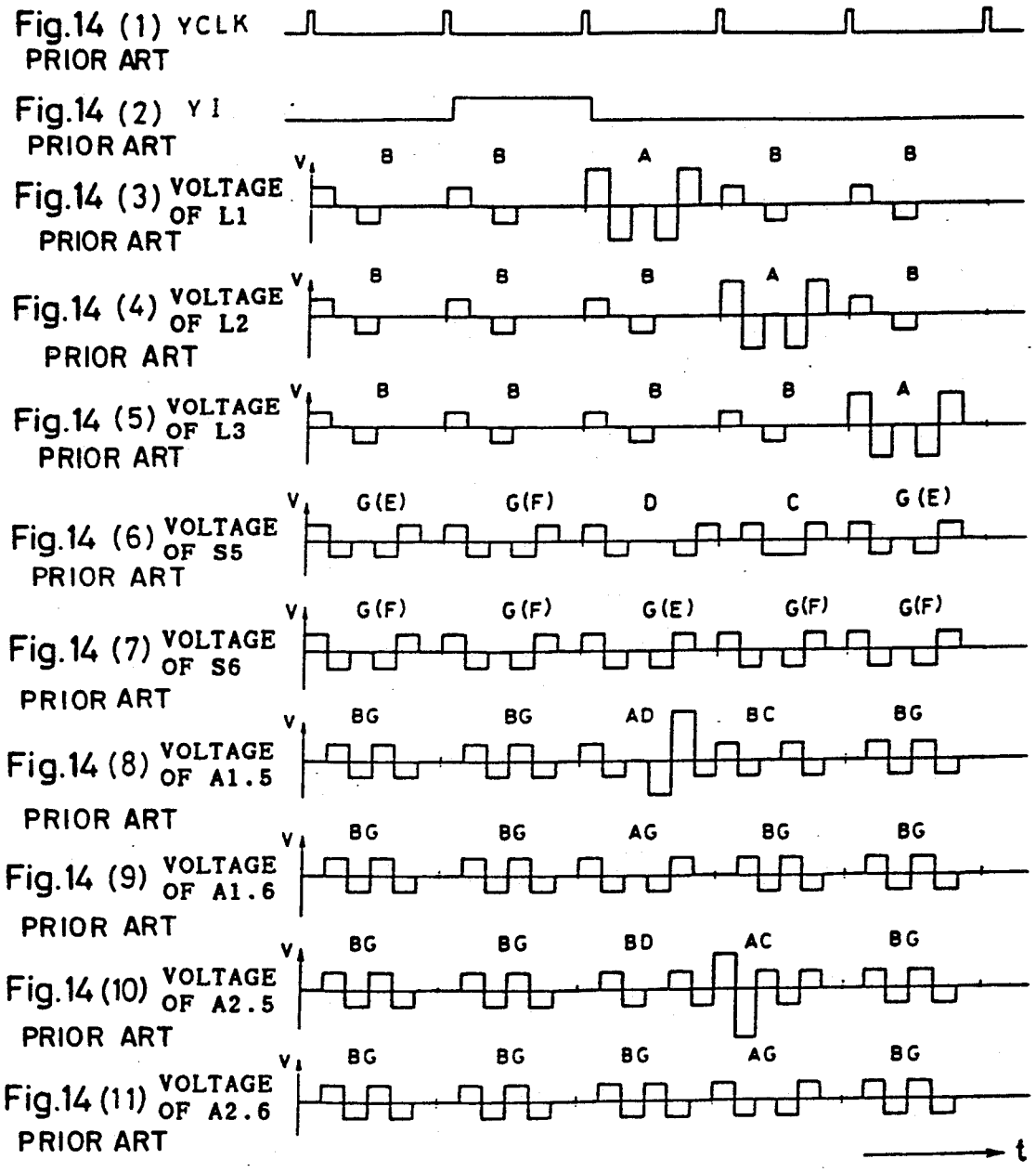

Accordingly, in the FLCD 20 of 32×16 aforementioned, using voltage waveform combinations shown in FIG. 12, when the display data DATA outputted from the personal computer 2 of FIG. 15 change from "FERROELECTRIC" to "ORDINARY DIELECTRIC", the voltage applied to the scanning electrodes L2, L3, L4, signal electrodes S1, S6 and picture elements A21, A26, A41, A46 is as shown in FIG. 32.

In this case, though the picture element A41 on the selected scanning electrode L4 is displayed "bright" in the preceding frame as well as in the succeeding frame, the signal voltage applied to the picture element A41 in the succeeding frame will be the bright rewriting voltage C. This is because that, since the scanning electrode L4 is the one which is decided to be selected in advance for every frame in the succeeding frame, regardless of changes of display in the preceding and succeeding frames, the picture elements on the scanning electrode are rewritten. To the picture element A46 whose dark display is continued in the preceding and succeeding frames, the dark rewriting voltage D is applied as the signal voltage in the succeeding frame and rewritten similarly.

However, though the picture element A21 on the selected scanning electrode L2 is displayed "bright" in the preceding frame as well as in the succeeding frame, since the scanning electrode L2 is not the one which is decided to be selected in advance for every frame, as same as the conventional example, the signal voltage applied in the succeeding frame to the picture element A21 whose display is not changed in the preceding and succeeding frames, will be the non-rewriting voltage G. It is similar for the picture element A26 whose dark display is continued in the preceding and succeeding frames.

In this frame, the scanning electrodes L4, L8 to L32 are decided to be selected in advance so that the rewriting voltage is applied to the picture elements on these electrodes as the signal voltage. Since the scanning electrodes which are decided to be selected in advance in the next frame are refreshed successively, all of the picture elements of the FLCD 20 are refreshed after four frames.

In such a way, p scanning electrodes, in which there is no difference of display data, are transcribed for every frame, and by rewriting the scanning electrode decided in advance for every frame successively, one scanning electrode can be transcribed after plural frames, thus changes in the display state due to the breakage of memory can be compensated.

In the following, another display control of the display control apparatus of the invention will be described.

Though the both picture elements of "bright" and "dark" are refreshed in several frames in the display control stated above, in the FLCD, depending on the picture element, there is a fragile direction of the display state, due to the orientation state of a panel. Therefore, the fragile direction of the picture elements display state is arranged in the panel by adjusting the rubbing and soon. Then, by adjusting an angle between an deflecting plate and the panel, it can be controlled to be fragile in the "bright" display or in the "dark" display.

FIG. 33 shows, in the FLCD 20 in which the "bright" display is fragile and unless the "bright" display is refreshed all picture elements are displayed in "dark", the voltage applied to the scanning electrodes L2, L3, L4, signal electrodes S1, S6 and picture elements A21, A26, A41, A46, when, as same as the embodiment 2, display data DATA outputted from the personal computer 2 of FIG. 15 has changed from "FERROELECTRIC" to "ORDINARY DIELECTRIC".

In this case, though the picture element A41 on the selected scanning electrode L4 is in the "bright" display in the preceding frame as well as in the succeeding frame, since the scanning electrode L4 is the one which is decided to be selected in advance for every frame, and the "bright" display is fragile and must be rewritten, the signal voltage applied to the picture element A41 in the succeeding frame is the bright rewriting voltage C. However, for the picture element A46 whose "dark" display is continued in the preceding and succeeding frames, even when the scanning electrode L4 is the one decided to be selected in advance for every frame, it is not necessary to be rewritten since the "dark" display is stable, thus same as the conventional example, the non-rewriting voltage G is applied in the succeeding frame as the signal voltage.

Other respects are same as the display control aforementioned.

FIG. 34 shows, in the FLCD 20 in which the "dark" display is fragile and unless the "dark" display is refreshed, all picture elements are displayed "dark", the voltage applied to the scanning electrodes L2, L3, L4, signal electrodes S1, S6 and picture elements A21, A26, A41, A46, when, as same as the embodiment 2, display data DATA outputted from the personal computer 2 of FIG. 15 has changed from "FERROELECTRIC" to "ORDINARY DIELECTRIC".

In this case, though the picture element A46 on the selected scanning electrode L4 is in the "dark" display in the preceding frame as well as in the succeeding frame, since the scanning electrode L4 is the one which is decided to be selected in advance for every frame, and the "dark" display is fragile and must be rewritten, the signal voltage applied to the picture element A46 in the succeeding frame is the dark rewriting voltage D. However, for the picture element A41 whose "bright" display is continued in the preceding and succeeding frames, even when the scanning electrode L4 is the one decided to be selected in advance for every frame, it is not necessary to be rewritten since the "bright" display is stable, thus same as the conventional example, the non-rewriting voltage G is applied in the succeeding frame as the signal voltage.

Other respects are same as the embodiment aforementioned.

In case the selective voltage is applied to the scanning electrode which is decided in advance for every frame in such a way, even when there is no change in the present display state and the display state in the succeeding frame of the picture element on the scanning electrode which is decided to be selected, in case the display state in the succeeding frame is the unstable one, the dark rewriting voltage or bright rewriting voltage is applied to the corresponding signal electrode, and in case the display state in the succeeding frame is the sable one, the non-rewriting voltage is applied to the corresponding signal electrode, thereby the unstable display state is transcribed and any changes in display state due to the breakage of memory in the unstable display can be compensated. That is, since the picture elements are rewritten according to the memory characteristic of the ferroelectric liquid crystal panel, it is possible to display a stable image despite of the memory breakage.

In the aforesaid embodiment, though the FLCD 20 having the picture elements of 32×16 has been referred to for the purpose of simplification, when the embodiment abovementioned is applied by using, practically, the FLCD having the picture elements of 1024×1024, all of which is designed to be refreshed in 16 frames, it has been confirmed that the display with little flickers and a fast response speed can be obtained.

Also, in the embodiment stated above, though transformation data Rx is held as it is in the difference data frame memory 28, output data DO of the display data frame memory 26 and output data DRE of the difference data frame memory 28 are not necessarily correspond to each other at the ratio of 1:1, it is also possible to correspond to each other at the ratio of, for example, 1:4. That is, when there is even one picture element, which is indicated in dark in FIG. 11, in the transformation data Rx corresponding to the picture elements A11 to A14, all of the output data DRE corresponding to the picture elements A11 to A14 may be brought to "1". In this way, the capacity of the difference data frame memory 28 can be reduced to a quarter.

In order to simplify the configuration of the embodiment stated above, though a static RAM was used in the difference data frame memory 28 and the display data frame memory 26, it is possible to use a dynamic RAM for the two memories.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to the embraced therein.

What is claimed is:

1. A display control method for a liquid crystal display device, the liquid crystal display device comprising a ferroelectric liquid crystal interposed between a plurality of scanning electrodes and a plurality of signal electrodes, the scanning electrodes arranged in a first direction and the signal electrodes arranged in a second direction intersecting the first direction, wherein intersection areas of the scanning electrodes and signal electrodes are formed into picture elements, said method comprising:

applying a selective voltage for rewriting the picture elements along a selected scanning electrode of a plurality of scanning electrodes;

applying a non-selective voltage for not rewriting the picture elements along each non-selected scanning electrode of said plurality of scanning electrodes; and applying a signal voltage to the individual signal electrodes, said signal voltage corresponding to data to be displayed by the picture elements along the selected scanning electrode;

the signal voltage being responsive to whether the picture element along the scanning electrode is changed from a bright display state to a dark display state, or from a dark display state to a bright display state, or the bright and dark display states are not changed;

wherein, for each vertical scanning period, a partial rewriting operation is performed comprising:

detecting for each scanning electrode whether there is a change in data to be displayed by the picture elements along that scanning electrode;

applying in a predetermined sequence a selective voltage to each scanning electrode having a detected change;

and applying a signal voltage to the signal electrodes corresponding to the detected change in data along each scanning electrode when the selective voltage is applied to that scanning electrode, wherein a transcribing operation to rewrite all of the picture elements within a preselected transcribing time period is conducted comprising:

dividing the plurality of scanning electrodes into a plurality of sets, each set having a predetermined number of scanning electrodes, sequentially rewriting the picture elements along each scanning electrode in a selected set in one vertical scanning period, and rewriting all of the picture elements within said preselected transcribing time period; and wherein, during each vertical scanning period, the method comprises securing time for completing the partial rewriting operation to update the data to be displayed in picture elements having a detected change and securing time for rewriting the picture elements along the scanning electrodes in the selected set.

2. The method of claim 1, wherein the vertical scanning period is one frame, the method further comprising performing, during one frame, the partial rewriting operation after rewriting the picture elements along the scanning electrodes in the selected set.

3. The method of claim 1, wherein the vertical scanning period is one frame, the method further comprising performing, during one frame, the partial rewriting operation before rewriting the picture elements along the scanning electrodes in the selected set.

4. The method of claim 1, wherein the vertical scanning period is one field in interlace scanning, the method further comprising securing in advance, during one field, the time for completing the partial rewriting operation.

5. The method of claim 1, further comprising providing a holding memory for storing the display state of the picture elements displayed on the liquid crystal display device for one picture frame, providing a display memory for storing data to be displayed next for one picture frame, providing a discrimination memory for storing data indicating whether there is a change in data of the display memory for any of the picture elements along each scanning electrode, using data from the holding memory to be displayed by the picture elements when transcribing full line scans of the selected scanning electrodes by the transcribing operation, and using data from the display memory to be displayed by the picture elements when there is a change in data to be rewritten in any of the picture elements along a selected scanning electrode.

6. The method of claim 5, wherein rewriting of picture elements when there is a change of data to be rewritten comprises obtaining the data for the picture elements along the selected scanning electrode from the display memory and storing it in a corresponding portion of the holding memory at the same time the data is used to rewrite the picture elements.

7. The method of claim 5, further comprising storing data to be displayed next in said display memory only after determining that the data presently stored in the display memory, which differs from the data to be displayed next and differs from the corresponding data in the holding memory, has been stored in the holding memory.

* * * * *